US007665271B2

(12) United States Patent
Kawai et al.

(10) Patent No.: US 7,665,271 B2
(45) Date of Patent: Feb. 23, 2010

(54) JOINT FITTING BETWEEN MEMBERS, JOINT STRUCTURE OF UPPER AND LOWER FLOOR VERTICAL FRAME MEMBERS, AND METHOD OF JOINING

(75) Inventors: Yoshimichi Kawai, Futtsu (JP); Kazunori Fujihashi, Tokyo (JP); Shigeaki Tohnai, Tokyo (JP); Hiroshi Tanaka, Futtsu (JP)

(73) Assignee: Nippon Steel Corporation, Tokyo (JP)

( * ) Notice: Subject to any disclaimer, the term of this patent is extended or adjusted under 35 U.S.C. 154(b) by 704 days.

(21) Appl. No.: 10/559,246

(22) PCT Filed: Sep. 5, 2005

(86) PCT No.: PCT/JP2005/016671

§ 371 (c)(1),
(2), (4) Date: Nov. 30, 2005

(87) PCT Pub. No.: WO2006/057099

PCT Pub. Date: Jun. 1, 2006

(65) Prior Publication Data

US 2007/0125034 A1 Jun. 7, 2007

(30) Foreign Application Priority Data

Nov. 25, 2004 (JP) ..... 2004-340092

(51) Int. Cl.
*E04B 5/18* (2006.01)

(52) U.S. Cl. ..... 52/698; 52/703; 52/715; 52/655.1

(58) Field of Classification Search ..... 52/79.13, 52/93.1, 93.2, 236.7, 167.1, 651.01, 698, 52/703, 715, 848, 223.11, 655.1, 712; 403/219; 14/14

See application file for complete search history.

(56) References Cited

U.S. PATENT DOCUMENTS

| | | | | | |
|---|---|---|---|---|---|
| 318,648 | A | * | 5/1885 | Paradise | 52/703 |
| 4,472,916 | A | * | 9/1984 | Krebs | 52/167.1 |
| 5,735,087 | A | * | 4/1998 | Olden | 52/715 |
| 5,819,484 | A | * | 10/1998 | Kar | 52/167.1 |
| 6,112,486 | A | * | 9/2000 | Ashton et al. | 52/698 |

FOREIGN PATENT DOCUMENTS

| | | |
|---|---|---|
| JP | 52-915 | 1/1977 |
| JP | 53-97218 | 8/1978 |
| JP | 58-191835 | 11/1983 |
| JP | 10-102602 | 4/1998 |
| JP | 2825228 B | 9/1998 |
| JP | 10-311110 | 11/1998 |
| KR | 1988-9176 | 9/1988 |

* cited by examiner

*Primary Examiner*—Richard E Chilcot, Jr.
*Assistant Examiner*—Matthew J Smith
(74) *Attorney, Agent, or Firm*—Kenyon & Kenyon LLP

(57) ABSTRACT

A metal connection member having joining parts on the upper and lower stories vertical frame members' side surfaces.

13 Claims, 19 Drawing Sheets

JOINT FITTING BETWEEN MEMBERS, JOINT STRUCTURE OF UPPER AND LOWER FLOOR VERTICAL FRAME MEMBERS, AND METHOD OF JOINING

TECHNICAL FIELD

The present invention relates to a joint fitting between members connecting vertical frame members, horizontal frame members, floor sub-lining materials, or roof truss chord members, and other members adjoining each other directly or spaced apart at upper and lower floors-of buildings, in particular steel house structures, so as to directly transmit compressive force and tensile force to these members and to a joint structure of upper and lower floor vertical frame members and a method of joining using that joint fitting between members.

BACKGROUND ART

In the past, when connecting an upper floor wall panel and a lower floor wall panel, there is known a structure using joint hardware comprised of three pieces of hardware consisting of two pieces of hold down hardware and a set of a connection bolt and nut, fastening the hold down hardware to the vertical frame stud in the upper floor wall panel, fastening the vertical frame stud to the hold down hardware in the lower floor wall panel, and connecting these hold down hardware by the bolt and nut connection hardware.

In a joint structure using joint hardware using such three pieces of hardware, when an earthquake or wind causes a horizontal force to act on the structure, since only tensile force can be transmitted, the compressive force is transmitted by the floor assembly parts. This requires complicated measures such as insertion of compression reinforcing hardware inside the floor assembly sandwiched between the vertical frame studs of the upper and lower floor wall panels, increases the number of pieces, and complicates the design and installation.

Further, as shown in FIG. 18 and FIG. 19, there is also known a joint structure of a type providing, instead of compression reinforcing hardware separately arranged inside the floor assembly, flanges 28 at the top and bottom of a cylindrical body 27 comprised of a steel pipe to form a flanged cylindrical body 29, arranging a connection bolt 30 inside the flanged cylindrical body 29, and connecting upper and lower hold down hardware 31, 32 by nuts 33 (for example, Japanese Patent Publication (A) No. 10-311110)

DISCLOSURE OF THE INVENTION

In the prior art, in each case, three separate types of hardware with large rigidity for transmitting stress including two pieces of hold down hardware 31, 32, a set of a connection bolt and nuts 30, 33, and compression reinforcing hardware or its equivalent flanged cylindrical body 29 are required. The number of pieces of hardware becomes greater, the structure becomes complicated, and the hold down hardware 31, 32 have to be arranged at the upper and lower floor sides. Further, the hold down hardware 31, 32 of these upper and lower floors become offset, so the through holes for these bolts are made larger to enable the connection bolt 30 to be positioned. Therefore, the horizontal direction distance L from the joint part X between the hold down hardware 31, 32 and the vertical frame members 11 to the center axis C of the connection bolt becomes larger, hold down hardware 31, 32 with large bending rigidity are required, and the installation is complicated and installation cost high. Further, there is the problem that insertion of the flanged cylindrical body 29 into the floor assembly 34 requires a high level of installation ability.

Further, a simple structure joint fitting able to transmit the stress of both compressive force and tensile force no matter what direction, that is, the vertical direction or horizontal direction or an inclined direction, arranged in has been desired.

The present invention has as its object the provision of a joint fitting between members with few parts and with a simple structure able to transmit the stress of both compressive force and tensile force and a joint structure and method of joining using the joint fitting.

The joint fitting between members of a first aspect of the invention is a joint fitting between members with ends to be connected to separate members so as to transmit compressive force and tensile force, characterized in that the joint fitting between members is provided with a metal connection member body having a length enabling arrangement bridging one member and another member to be joined and joint parts directly joining with these members at its two ends.

In a joint fitting between members of a second aspect of the invention, there is provided a joint fitting between members connecting an upper floor vertical frame member and a lower floor vertical frame member to transmit compressive force and tensile force, characterized in that the joint fitting between members is provided with a metal connection member body having a length enabling it to be arranged bridging the upper floor vertical frame member and lower floor vertical frame member in a vertical orientation and joint parts directly joining with these vertical frame members at its two ends.

In a third aspect of the invention, there is provided a joint fitting between members of the first or second aspects of the invention characterized in that the metal connection member body is comprised of a single steel pipe which is deformed by crushing at its two ends to form flat parts and the flat parts are formed with joint parts.

In a fourth aspect of the invention, there is provided a joint fitting between members of a third aspect of the invention characterized in that the two ends of the steel pipe are shaped with recessed cross-sections provided with projections at the two sides of the flat parts in the width direction and those parts are made the joint parts.

In a fifth aspect of the invention, there is provided a joint fitting between members of the first or second aspect of the invention characterized in that the metal connection member body is comprised of a steel bar which has joint plates having joint parts fastened to it at its two ends in the longitudinal direction and in that the joint plates are arranged co-planar.

In a sixth aspect of the invention, there is provided a joint fitting between members of the fifth aspect of the invention characterized in that the joint plates are formed with notched parts and in that parts of the ends of the steel bar in the radial direction are arranged accommodated in the grooves formed by the notched parts so as not to stick out and are fastened to the joint plates by welding.

In a seventh aspect of the invention, there is provided the joint fitting between members of the first or a second aspect of the invention characterized in that the joint hardware is made a metal connection member body comprised of steel sheet bent to form a steel material with a groove shaped cross-section and in that the two ends of the metal connection member body are formed with joint parts having flat parts.

In an eighth aspect of the invention, there is provided a joint fitting between members of any of the first aspect of the invention to the seventh aspect of the invention characterized in that the joint parts are made joint parts able to be joined by drill screws or bolts or other fasteners.

In a ninth aspect of the invention, there is provided a joint fitting between members of any of the third, fourth, or seventh aspects of the invention wherein the flat parts are provided with starting holes for joining use.

In a 10th aspect of the invention, there is provided a joint fitting between members of any of the first aspect of the invention to the ninth aspect of the invention characterized in that an external dimension in the width direction at an intermediate part of the joint fitting between members is made smaller than the external dimension in the width direction at the two ends, the external dimensions in the width direction at the two ends are made smaller than the dimensions in the long side direction of the through holes provided in the upper floor members and lower floor and other members inserted through and larger than the dimensions in the short side direction of the through holes, and the external dimension in the width direction at the intermediate part is made smaller than the dimensions in the short side direction of the through holes.

A joint structure between adjoining members in a building in an 11th aspect of the invention is characterized in that a joint fitting between members of any of the first aspect of the invention to the 10th aspect of the invention is used and in that adjoining horizontal frame members or floor joists or roof truss chord members or other adjoining members in a building are joined.

A joint structure of upper and lower floor vertical frame members of a 12th aspect of the invention characterized in that upper and lower joint parts in a joint fitting between members of any of the first aspect of the invention to the 10th aspect of the invention are brought into contact with vertical side surfaces of the vertical frame members of the floors and are fastened by drill screws or bolts or other fasteners provided bridging the joint parts and vertical frame members in a horizontal orientation.

A method of joining members of a 13th aspect of the invention characterized by forming a joint structure of the 11th aspect of the invention or the 12th aspect of the invention during which bringing one joint part of the joint parts of the two ends at the joint fitting between members of any of the first to the 10th aspects of the invention into contact with the member to be joined to and fastening it by providing drill screws or bolts or other fasteners bridging the joint part and the member to be joined to, then bringing the other joint part into contact with the other member to be joined to and fastening it by providing drill screws or bolts or other fasteners.

A method of joining upper and lower floor vertical frame members of a 14th aspect of the invention, characterized by forming a joint structure of the 11th or 12th aspect of the invention during which bringing one joint part of the upper and lower joint parts in a joint fitting between members of any of the first aspect of the invention to the 10th aspect of the invention into contact with a vertical side surface of the frame member of either of the upper and lower floors and fastening it by providing drill screws or bolts or other fasteners bridging the joint part and vertical frame member in a horizontal orientation, then bringing the other joint part into contact with the vertical side surface of the vertical frame member of the other floor and fastening it by providing drill screws or bolts or other fasteners in a horizontal orientation.

According to the first aspect of the invention, since there is provided a joint fitting between members with ends to be connected to separate members so as to transmit compressive force and tensile force, wherein the joint fitting between members is provided with a metal connection member body having a length enabling arrangement bridging one member and another member to be joined and joint parts directly joining with these members at its two ends, the configuration of the joint fitting can be made extremely simple.

That is, it is possible to replace the conventional structure of using a large number of parts to transmit compressive force and tensile force with a single member to transmit the tensile force and compressive force, so it is possible to provide an inexpensive joint fitting between members.

For this reason, it is possible to provide a joint fitting between members which can streamline the design and installation of steel house structures, improve the installation efficiency, and reduce the installation costs.

According to the second aspect of the invention, there is provided a joint fitting between members made joint hardware provided with a continuous single metal connection member body having a length enabling it to be arranged bridging the upper floor vertical frame member and lower floor vertical frame member in a vertical orientation.

That is, not only is reinforcing hardware for the upper floor and lower floor hold down hardware not required as in the past, it is possible to replace the structure of transmitting compressive force and tensile force by a flanged cylindrical body and bolts or other numerous parts provided inside with a single member not requiring any reinforcing hardware so as to transmit the tensile force and compressive force, so it is possible to provide an inexpensive joint fitting between members.

For this reason, it is possible to provide a joint fitting between members which can streamline the design and installation of steel house structures, improve the installation efficiency, and reduce the installation costs.

According to the third aspect of the invention, since the metal connection member body is made a steel pipe, it is possible to simply deform by crushing the two ends of commercially available inexpensive steel pipe to form flat parts, possible to easily form a joint fitting between members having joint parts by just providing starting holes at the flat parts in accordance with need, and possible to provide an inexpensive joint fitting between members by easy fabrication.

According to the fourth aspect of the invention, since the flat parts are shaped with recessed cross-sections provided with projections at the two sides in the width direction, it is possible to provide a joint fitting between members improved in bending rigidity of the joint parts.

According to the fifth aspect of the invention, since the metal connection member body is made a steel bar, it is possible to easily provide a joint fitting between members by just fastening joint plates to the two ends of a commercially available inexpensive steel bar and possible to provide an easy-to-fabricate, more inexpensive joint fitting between members.

According to a sixth aspect of the invention, since the joint plates are formed with notched parts, ends of the steel bar are arranged in the grooves formed by the notched parts, and the steel bar is arranged held so that parts of the ends in the radial direction do not stick out, it is possible bring the joint surfaces of the joint plates close to the center axis of the steel bar, that is, it is possible to bring the vertical frame members and center axis of the joint fitting between members close and make the bending force acting on them smaller.

According to the seventh aspect of the invention, it is possible to simply bend steel sheet to provide a metal connection member body with a large bending rigidity of the groove cross-section and, further, it is possible to provide a joint fitting between members adjusted in bending rigidity in the member longitudinal direction by suitably changing the depth of the groove.

According to the eighth aspect of the invention, since the joint parts can be joined by drill screws or bolts or other fasteners, it is possible to provide a joint fitting between members able to be easily joined by commercially available inexpensive fasteners.

According to the ninth aspect of the invention, since starting holes for joining use are provided at the flat parts, it is possible to use the starting holes to screw in drill screws or use the starting holes for passing bolts to facilitate joining with the vertical frame members.

According to the 10th aspect of the invention, it is possible rotate the joint fitting between members at the intermediate part where the outside diameter dimension is smaller than the member ends at the time of rotation, possible to reduce the width dimension of the through holes in the member width direction in the upper floor member and lower floor member, and possible to obtain a member with a large bending rigidity.

According to the 11th aspect of the invention, it is possible to provide a joint structure which can join adjoining members in a building such as horizontal frame members, floor joists, or roof truss chord members by connection by a simple structure joint fitting between members, the connecting joint structure between members becomes simple in structure, installation becomes easy, and compressive force and tensile force can be reliably transmitted and further possible to arrange it in the vertical direction, horizontal direction, inclined direction, or other suitable direction, so the general usability is high.

According to the 12th aspect of the invention, it is possible to provide a simple structure joint structure wherein upper and lower joint parts of a joint fitting between members having a metal connection member body having joint parts at its two ends are brought into contact with vertical side surfaces of vertical frame members of the different floors and are fastened by drill screws or bolts or other fasteners attached in the horizontal direction and the compressive force and tensile force in the vertical direction can be transmitted through the joint fitting between members and fasteners. Further, since a single metal connection member is arranged so as to contact the vertical frame members bridging the upper and lower floor vertical frame members so as to join them, it is possible to reduce the offset distance from the upper and lower vertical frame members to the center axis of the metal connection member and, when transmitting the tensile force and tensile force, possible to obtain a structure with a small load of the bending moment of the vertical frame members and metal connection member.

According to the 13th aspect of the invention, since bringing one joint part of the joint parts of the joint fitting between members into contact with the member to be joined to and fastening it by providing a fastening device comprised of drill screws or bolts or other fasteners bridging the joint part and the member to be joined to, then bringing the other joint part into contact with the other member to be joined to and fastening it by providing a fastening device comprised of drill screws or bolts or other fasteners, it is possible to use a simple structure joint fitting between members and easily join the joint parts of the joint fitting using drill screws or other simple fastening devices, so it is possible to easily connect and join separate members arranged in a line or in a line spaced apart, installation is easy and the installation efficiency can be improved, and the installation cost can be reduced.

According to a 14th aspect of the invention, since a joint fitting between members provided with a single metal connection member body able to transmit compressive force and tensile force is arranged bridging the upper floor and lower floor vertical frame members and the upper and lower joint parts of the joint fitting between members are joined to the different floor vertical frame members, installation can be streamlined and a method of joining upper and lower floor vertical frame members easy in installation can be provided. Further, since it is possible to bring the joint fitting between members into contact with the vertical frame members bridging the upper and lower floors from either the upper floor side or lower floor side, there is also greater freedom of installation.

BRIEF DESCRIPTION OF THE DRAWINGS

FIG. 3(*b*) is a cross-sectional view along the line B-B of FIG. 2.

FIG. 4(*b*) is a view of the relationship between a through hole in another part and a joint fitting between members.

FIG. 5(*b*) is a partial horizontal plan view showing the relationship between a joint fitting between members and elongated hole when providing elongated holes in the upper and lower flanges.

FIG. 6(*b*) is a front view of a joint fitting between members of a first embodiment used in the present invention.

FIG. 7(*b*) is a cross-sectional view along the line E-E of FIG. 6.

FIG. 7(*c*) is a cross-sectional view of a modified shape of the cross-sectional shape shown in FIG. 7(*b*).

FIG. 9(*b*) is a cross-sectional view along the line F-F of FIG. 9(*a*).

FIG. 9(*c*) is a cross-sectional view along the line G-G of FIG. 9(*a*).

FIG. 11(*b*) is a cross-sectional view along the line H-H of FIG. 11(*a*).

FIG. 11(*c*) is a cross-sectional view along the line I-I of FIG. 11(*a*).

FIG. 12(*b*) is a partial horizontal sectional plan view showing the relationship between the joint fitting between members and through hole used in the second and third embodiments.

FIG. 14(*b*) is a cross-sectional view along the line J-J of FIG. 14(*a*).

FIG. 14(*c*) is a cross-sectional view along the line K-K of FIG. 14(*a*).

FIG. 15(*b*) is a partial horizontal sectional plan view showing the relationship between the joint fitting between members and through hole used in the fourth embodiment.

BEST MODE FOR WORKING THE INVENTION

Next, the present invention will be explained in detail based on the illustrated embodiments.

Figure 6A:
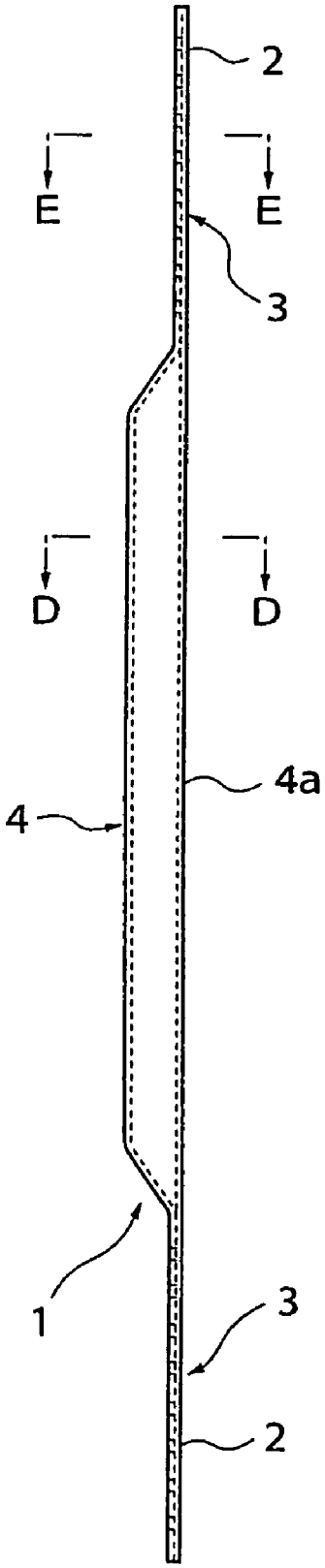
FIG. 6(*a*) is a side view of a joint fitting between members of a first embodiment used in the present invention.
Figure 6B:
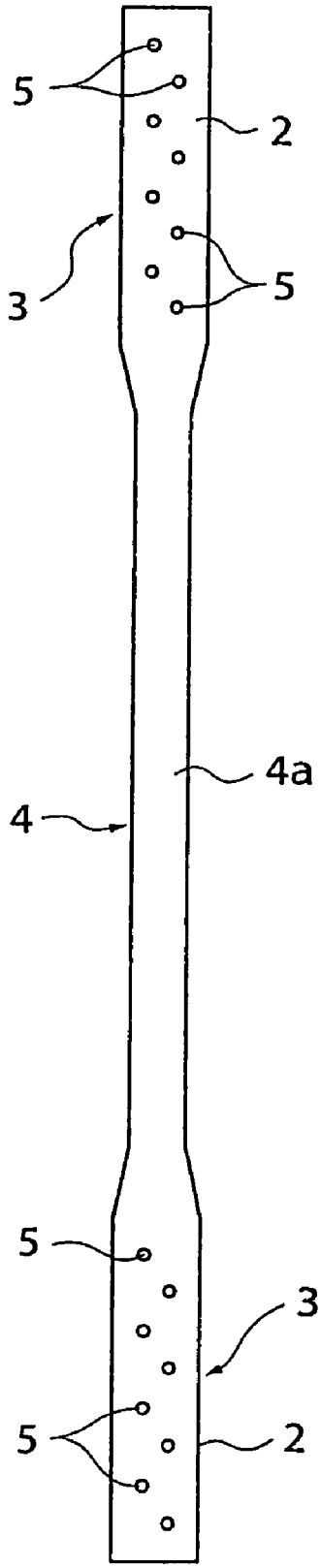
Figure 7A:
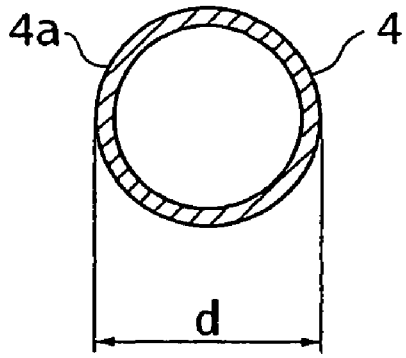
FIG. 7(*a*) is a cross-sectional view along the line D-D of FIG. 6.
Figure 7B:
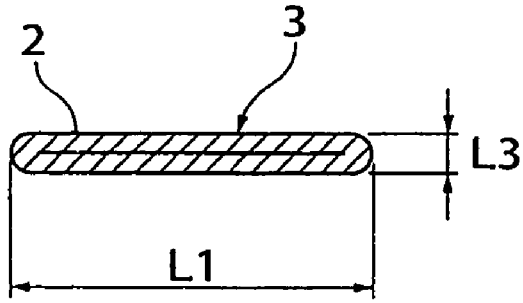
Figure 7C:
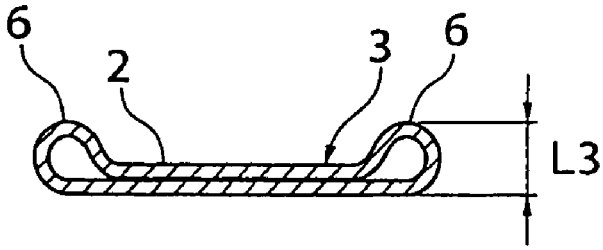

First, explaining a joint fitting between members of a first embodiment of the present invention with reference to FIG. 6(*a*), FIG. 6(*b*) and FIG. 7(*a*), FIG. 7(*b*), the illustrated joint fitting 1 between members is made a joint fitting 1 between members comprised of joint hardware consisting of a steel pipe or other single metal pipe member having a length extending from an upper end of a lower floor vertical frame member to a lower end of an upper floor vertical frame member and deformed by crushing at its two ends to provide flat parts 2 at the two ends so as to form a metal connection member body 4, the flat parts 2 of the metal connection member body 4 being formed with joint parts 3 able to be joined by drill screws or bolts or other fasteners.

In the form shown in FIG. 6(*a*) and FIG. 6(*b*), as shown by 7 (*b*), the two ends of the steel pipe 4*a*are crushed flat so as to be biased to one side in the radial direction when seen in horizontal cross-section and thereby obtain a metal connection member body 4 having flat parts 2 at its two ends, and the flat parts 2 are provided with starting holes 5 for the drill screws. Other than the starting holes 5 for the drill screws, the holes may also be for joining using bolts or other fasteners. In the illustrated embodiment, the flat parts 2 at the upper and lower ends are formed to be on the same plane, and the surfaces contacting the upper and lower floor vertical frame members are on the same vertical plane.

Further, when forming the flat parts 2 in the metal connection member body 4, as shown in FIG. 7(*c*), it is also possible to crush the middle part of each end in the width direction and make the two sides of each flat part 2 in the width direction into projections 6 with inside surfaces separated from each other so as to obtain a groove shaped cross-section joint part 3 provided with projections 6 extending in the longitudinal direction of the member at the end of the member. By doing this, it is possible to obtain a joint fitting 1 between members improved in the rigidity of the joint parts 3 (bending rigidity or buckling strength).

Further, the joint fitting 1 for upper and lower floor vertical frame members of this embodiment and the later embodiments is made vertically symmetric in shape and can be used even if turned upside down.

Figure 4A:
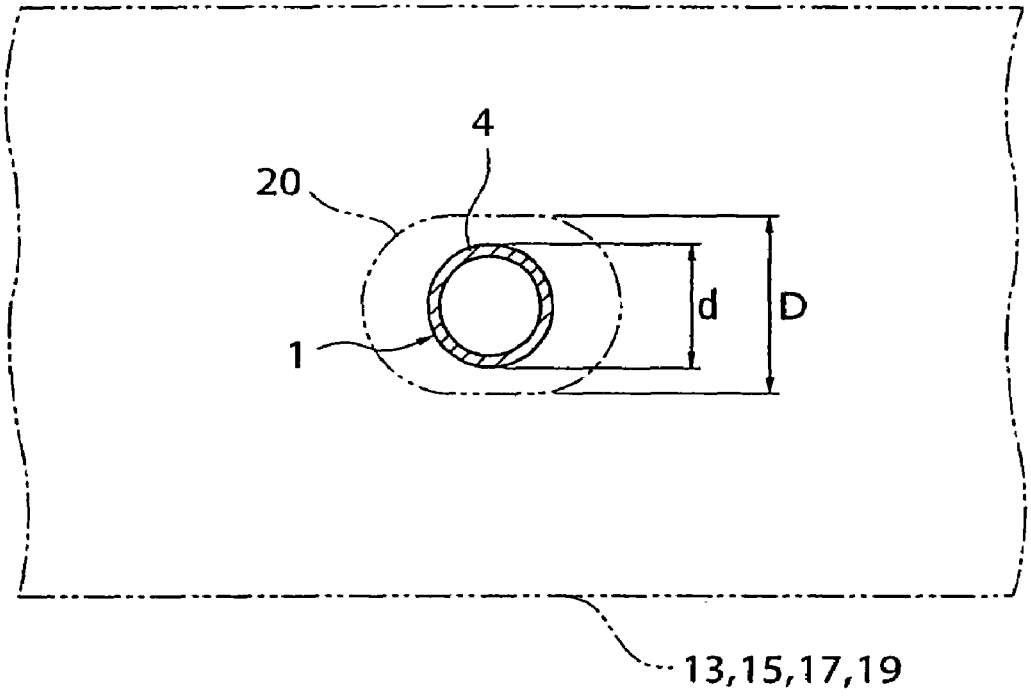
FIG. 4(*a*) is a view of the relationship between a through hole in another part and a joint fitting between members.
Figure 4B:
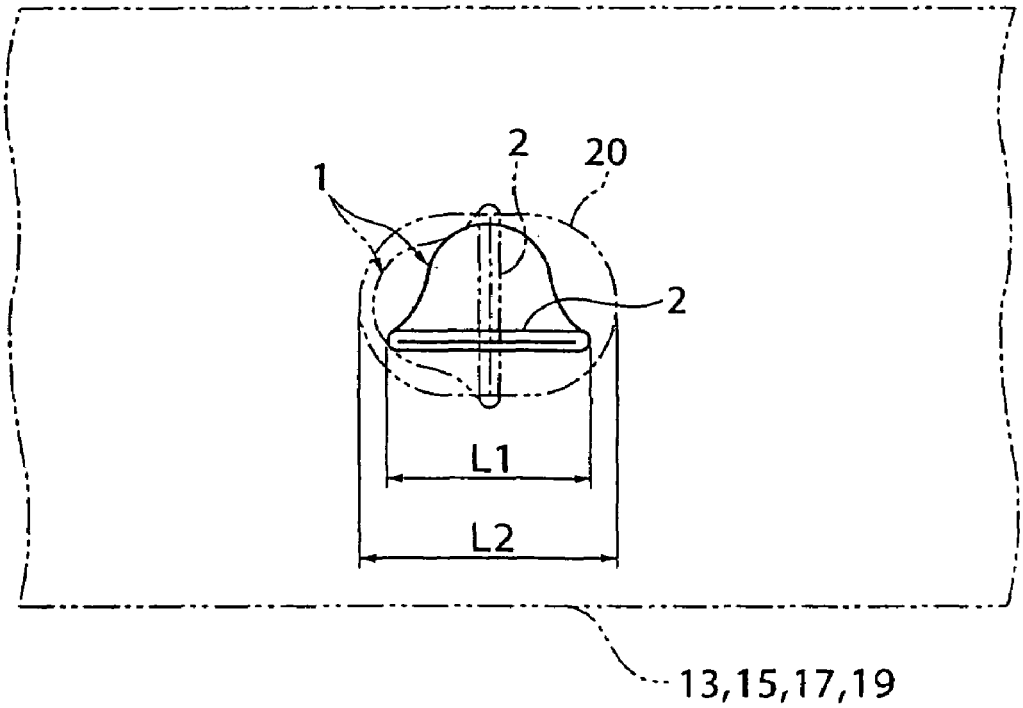

As shown in FIG. 7(*a*), FIG. 7(*b*) and FIG. 4(*a*), FIG. 4(*b*), compared with the external dimension L1 in the horizontal axial direction at the joint part 3 at each end of the joint fitting between members, the external dimension d in the same horizontal width direction as above of the middle part in the vertical direction is made smaller, the dimension in the perpendicular direction of the joint part 3 (vertical direction) at the middle part in the vertical direction is made larger, and the bending rigidity and buckling strength are made larger. The external dimension L1 of the two ends is made smaller than the long side direction dimension L2 of the elongated through holes 20 provided at the upper floor member (17, 19) and lower floor member (13, 15) and made larger than the short side direction dimension D of the elongated through holes 20. The thickness direction dimension L3 of the two ends is made smaller than the short side direction dimension D of the elongated through holes 20, the maximum external dimension at the time of rotation of the middle part is made smaller than the short side direction dimension D of the elongated through holes 20, and the middle part of the joint fitting 1 is positioned at the parts of the elongated through holes 20 to enable rotation.

By having the external dimension L1 in the width direction of the upper and lower ends of the upper and lower floors vertical frame joint fittings 1 set smaller than the long side direction dimension L2 of the elongated through holes 20 provided at the upper and lower floor members (13, 15, 17, 19), no matter which of the upper floor or lower floor direction the joint fitting 1 between members is inserted from into the elongated through holes 20 provided at the upper and lower floor members (13, 15, 17, 19), it is possible to insert the joint fitting 1 between members with the direction of elongation of the ends matched with the direction of elongation of the elongated through holes 20, arrange the middle part with the small horizontal dimension and large bending rigidity and buckling strength at the middle of the joint fitting 1 between members at the part of the elongated through holes 20 of the upper and lower floor members (13, 15, 17, 19), and in that state rotate it substantially horizontally to arrange it in the attachment state.

That is, the joint parts 3 with the wide widths at the ends of the joint fitting 1 between members are not horizontally rotated at the parts of the elongated through holes 20 of the upper and lower floor members (13, 15, 17, 19). The small horizontal cross-section outside diameter dimension part of the middle part in the joint fitting 1 between members is positioned at the parts of the upper floor elongated through hole 20 and lower floor elongated through hole 20 and rotated substantially horizontally so that the joint fitting 11 between members turns so as to enable the joint posture to be adjusted.

Figure 3A:
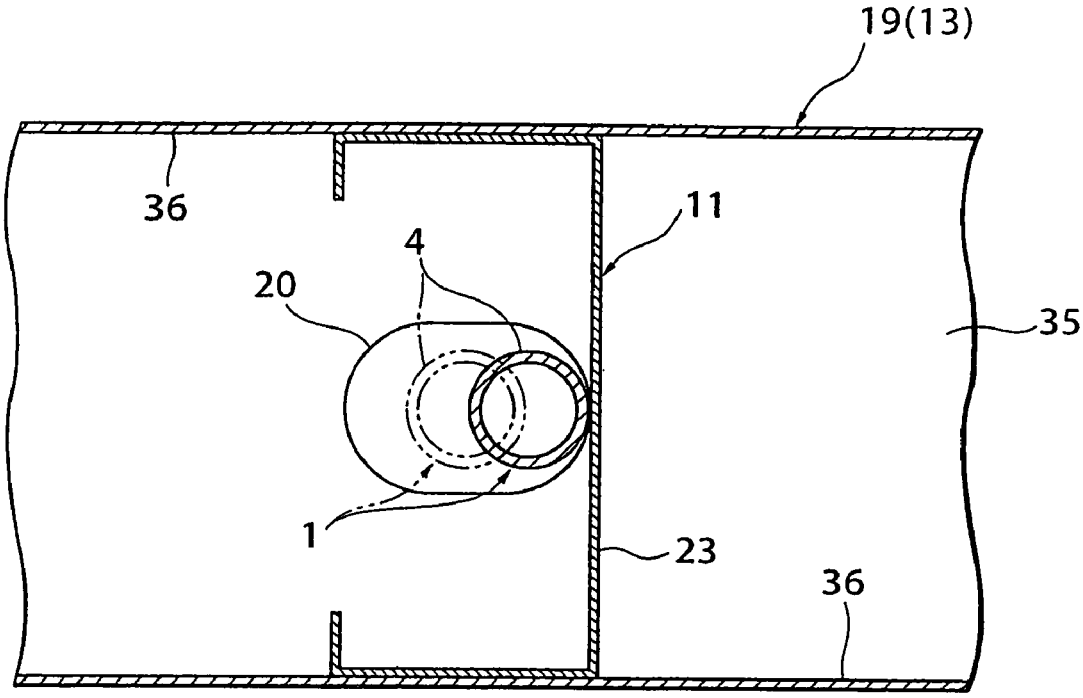
FIG. 3(*a*) is a cross-sectional view along the line A-A of FIG. 2.
Figure 3B:
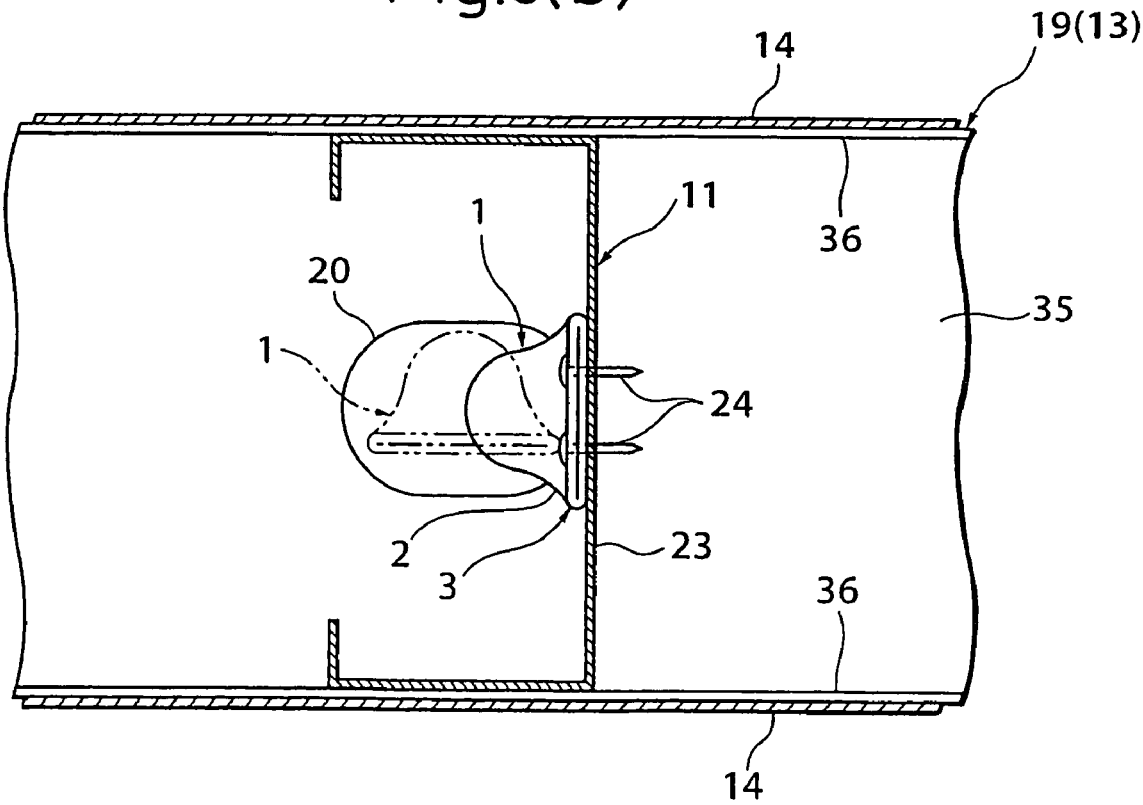

Further, as shown in FIG. 4(*a*), FIG. 4(*b*) (or see FIG. 3(*a*), FIG. 3(*b*)), as explained above, the through holes 20 provided at the upper floor and lower floor members 13, 15, 17, 19 (webs 35 of lower frame member 19 and upper frame member 13 comprised of upper and lower groove members at the frame members forming the wall panels 12, 18) are made elongated through holes 20 long in the longitudinal direction of the members and the elongated through holes 20 are not close to the width direction ends (flanges 36) of the members (13, 19), so in the case of receiving from the structure surface material 14 a force acting at the member width direction end side so as to cause a tensile force parallel to the wall panel surface (tensile force parallel to the flange), there is little cross-sectional damage in the width direction of the web 35, so it is possible to prevent a large drop in the rigidity of the web 35.

Figure 1:
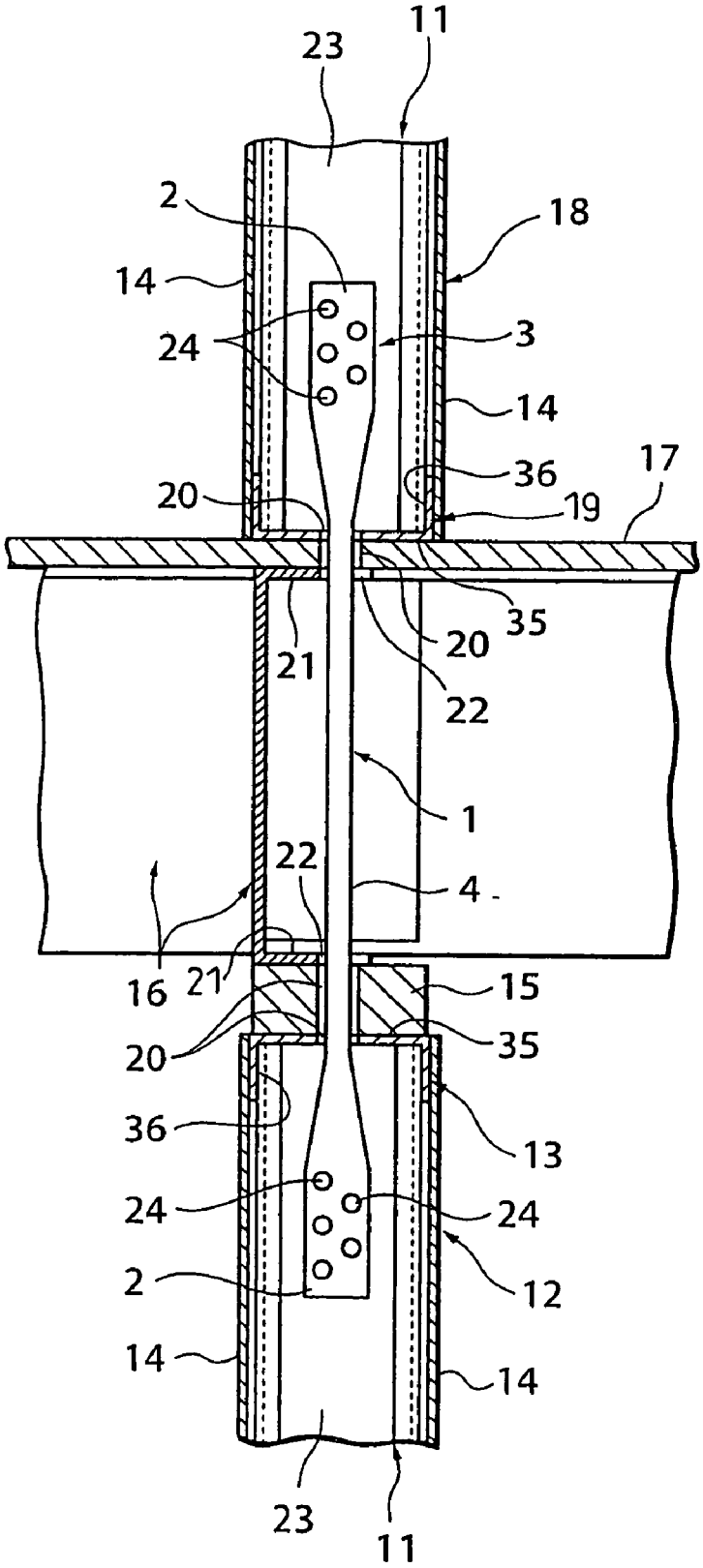
FIG. 1 is a vertical front view of the state of using a joint fitting between members of a first embodiment of the present invention to join vertical frame members of upper and lower floors.
Figure 2:
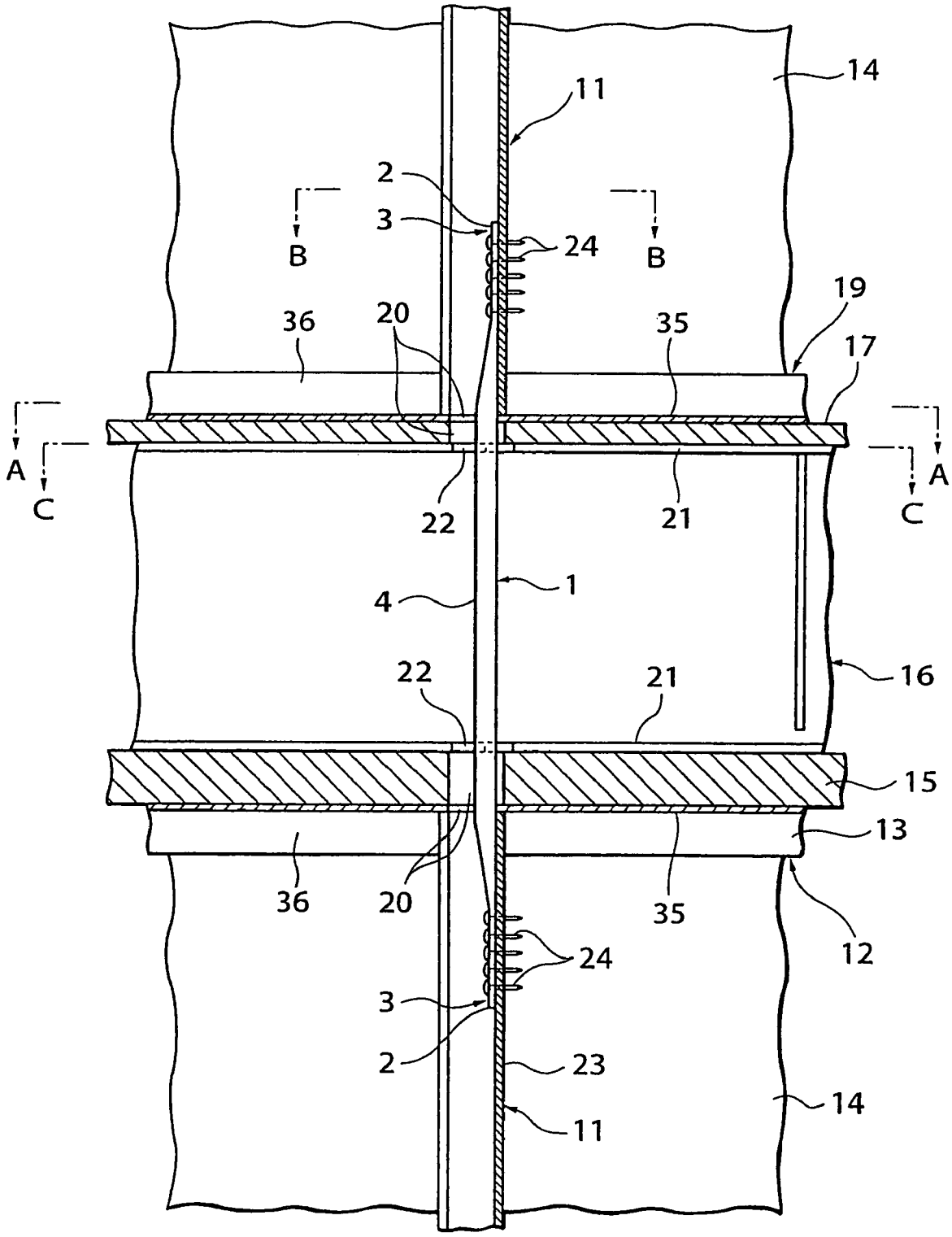
FIG. 2 is a vertical sectional side view of FIG. 1.

For example, as another embodiment of the elongated through holes 20, it is also possible to use elongated through holes 20 having planar shapes similar to the planar shape of the joint fitting 1 for the upper and lower floor external frame members, having somewhat large dimensions, and having lengths enabling approach to the web joint surfaces of the vertical frame members 11 (see FIG. 2).

As explained above, when using the joint fitting 1 between members of the present invention to join upper and lower floor vertical frame members 11, the offset distance in the horizontal direction between the joint surfaces with the upper and lower floor vertical frame members 11 and the center axis of the joint fitting 1 between members can be reduced and the bending force acting on the upper and lower floor vertical frame members 11 and the joint fitting 1 between members can be reduced. For this reason, the joint fitting between members can be economically designed.

The joint fitting 1 between members of the present invention and the joint structure using that fitting, in addition to the above embodiment, while not illustrated, may also be used for connecting and joining members adjoining each other in a line in a building such as horizontal frame members, floor joists, roof truss-forming chord members, etc. In particular, with member ends adjoining each other in a line, member ends spaced apart, or member ends of roof trusses aligned tilted so as to make them line up or approach, it can be used for connecting and joining members by joining joint hardware to the member ends. The connection and joining enable transmission of compressive force or tensile force between members in the vertical direction, horizontal direction, or inclined direction. Below, however, the explanation will be given of an embodiment using the joint fitting 1 between members to join vertical frame members 11 arranged at the upper floor and lower floor with reference to FIG. 1 to FIGS. 5(*a*), 5(*b*).

In the steel house structure of the illustrated embodiment, the lower floor wall panel 12 arranged and fastened at the lower floor is provided with a groove cross-section upper frame member (upper horizontal frame member) 13, a lower frame member (lower horizontal frame member, not shown) made of thin steel sheet bent to a recessed shape, a vertical frame member 11 with a lip in horizontal cross-section with ends connected to these, and a thin steel sheet or other structure surface member 14 fastened by screws or drill screws or other fasteners (not shown) to one or both surfaces of the same.

Figure 16:
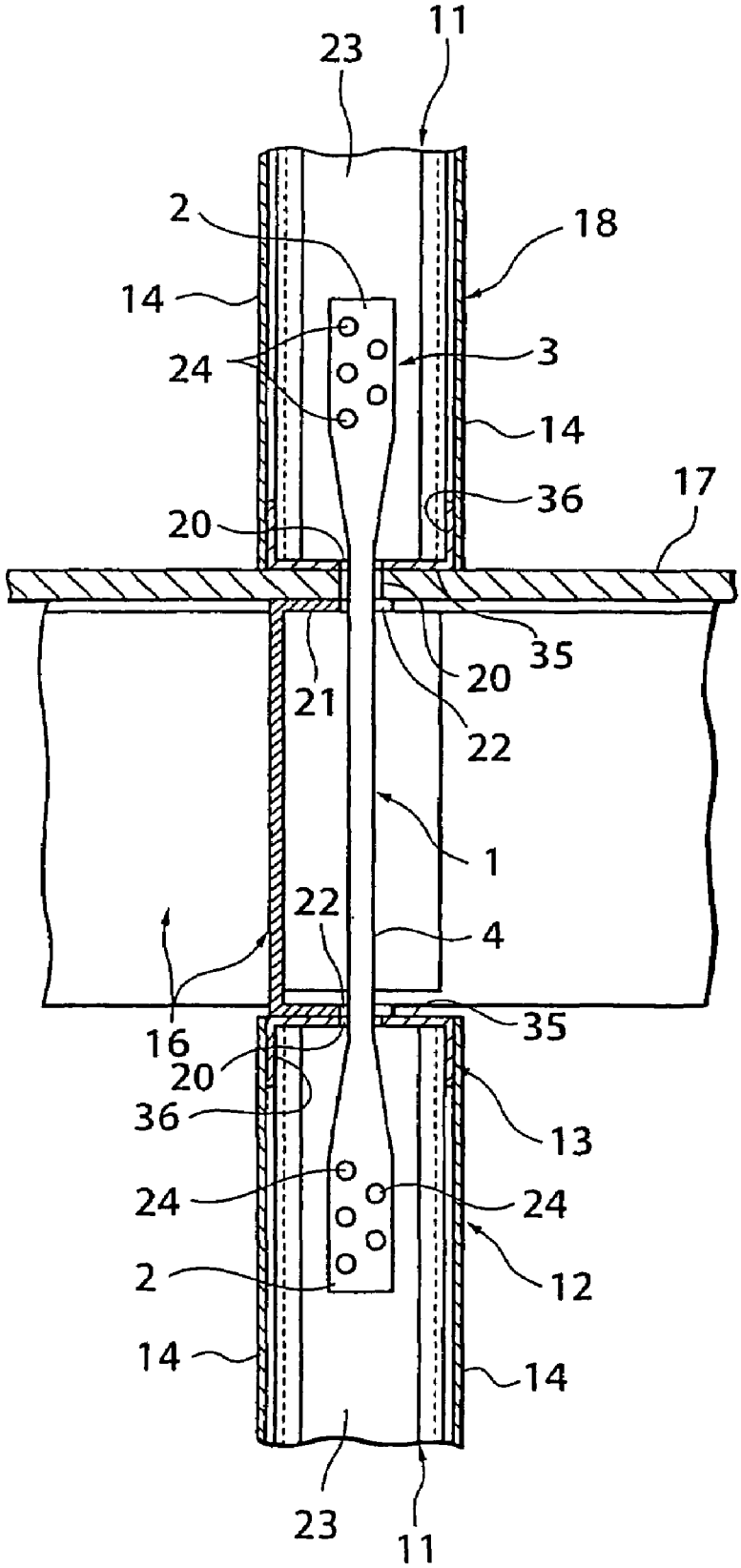
FIG. 16 is a vertical sectional front view of the state using a typical type of a joint fitting between members of the present invention to join vertical frame members of upper and lower floors in a joint structure not requiring any upper frame reinforcing members.
Figure 17:
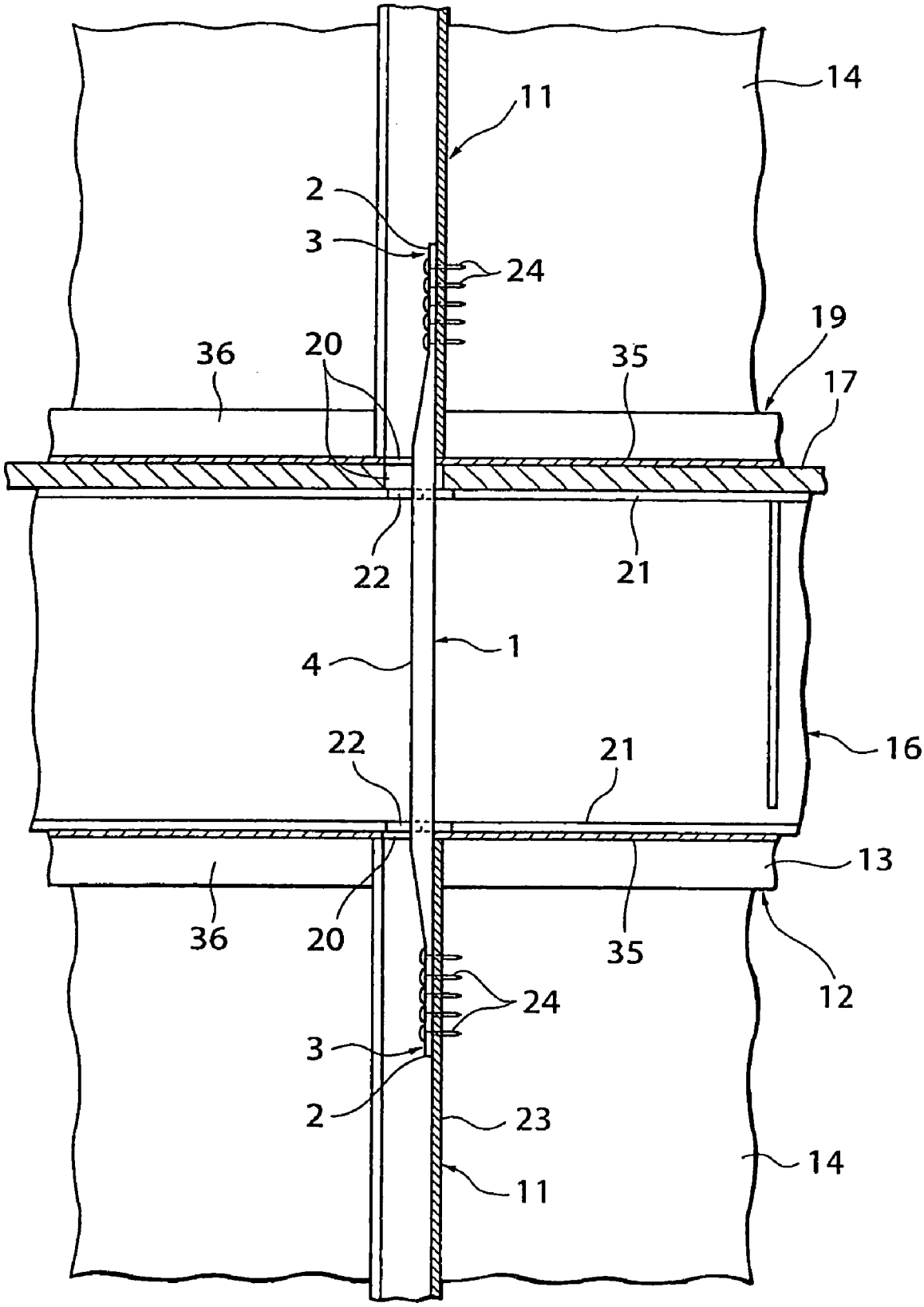
FIG. 17 is a vertical sectional side view of FIG. 16.
Figure 18:
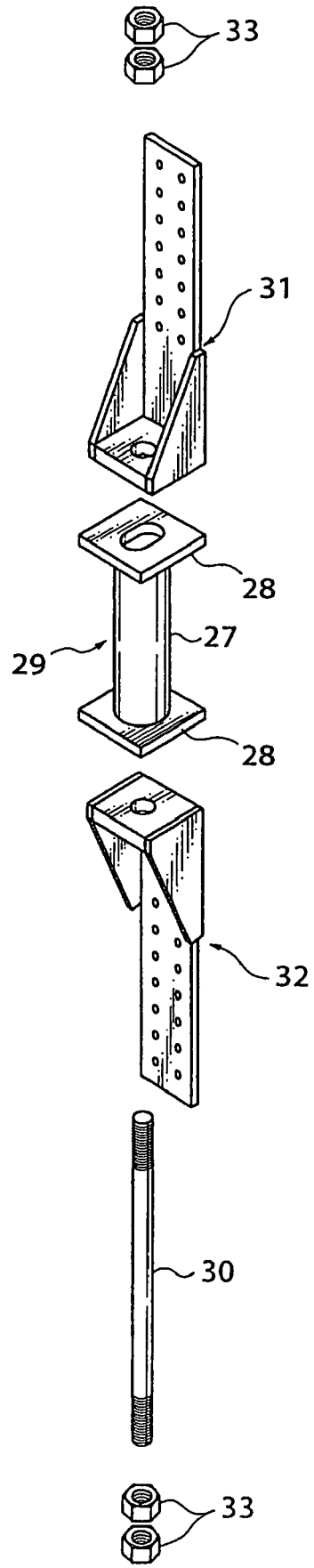
FIG. 18 is a perspective view showing disassembled a joint fitting used in a conventional joint structure.
Figure 19:
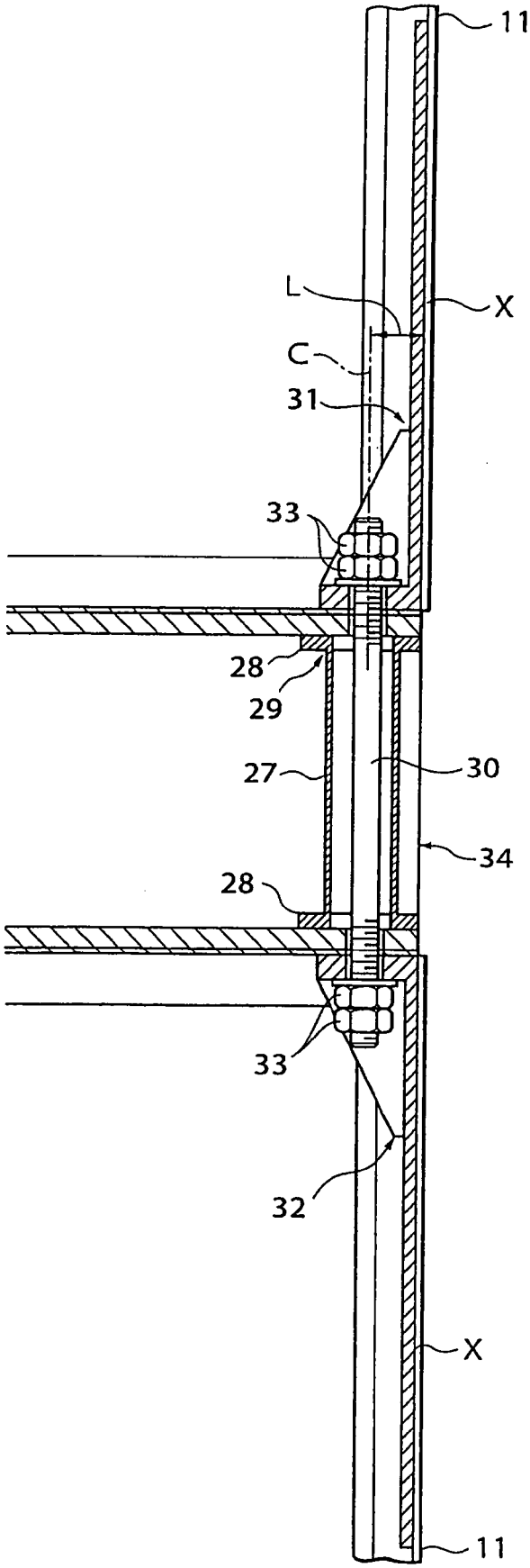
FIG. 19 is a vertical side view showing the state of using the joint fitting shown in FIG. 13 to join an upper floor side and lower floor side.

The lower floor wall panel 12 is connected to and assembled with the foundation or a lower wall panel etc. A wood block or other upper frame reinforcing material 15 is placed along the upper frame member 13 of the lower floor wall panel 12 and fastened by drill screws or other fasteners. An end joist or side joist 16 is arranged on the upper frame reinforcing member 15. Note that when the yield strength of the upper frame member 13 etc. is large, in a typical embodiment, as shown in FIG. 16 and FIG. 17, the upper frame reinforcing member 15 is omitted and the end joist or side joist 16 is directly placed on the upper frame member 13.

The end joist or side joist 16 has a not shown floor joist or ceiling joist fastened to it, a floor sub-lining material 17 is placed on the upper flanges 21 of the end joist or side joist 16 and floor joist and fastened by drill screws or other fasteners, an upper floor wall panel 18 of the same structure as the lower floor wall panel 12 is attached in the same vertical state as the lower floor wall panel 12 on the floor sub-lining material 17, and the web 35 of the groove cross-section lower frame member 19 at the upper floor wall panel 18 is placed on the floor sub-lining material 17 and fastened there by drill screws or other fasteners.

Figure 5A:
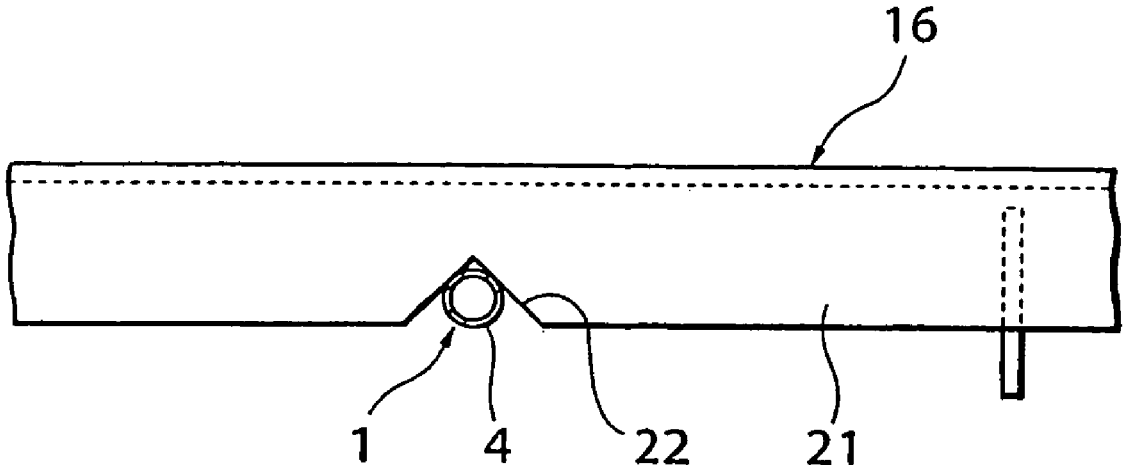
FIG. 5(*a*) is a cross-sectional view along the line C-C of FIG. 2.
Figure 5B:
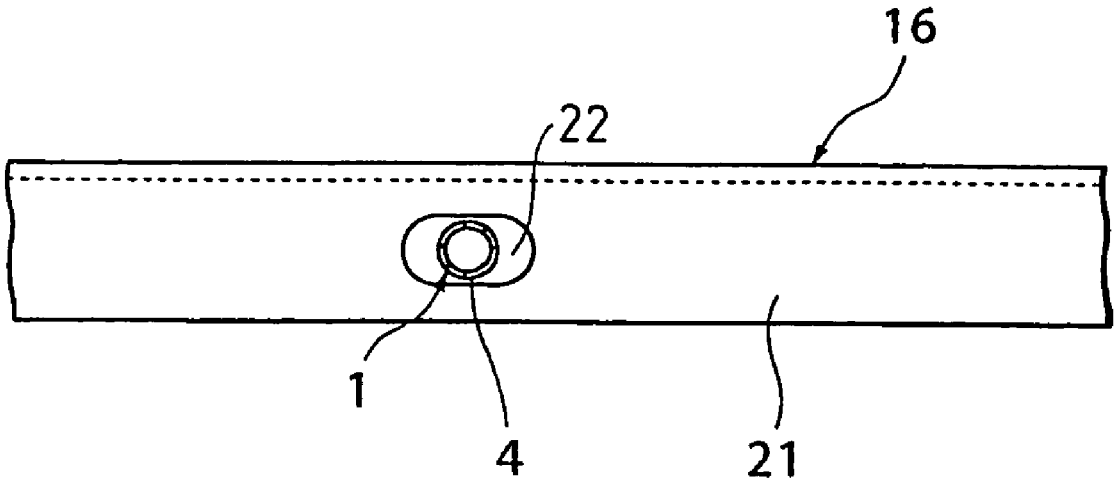

The web 35 of the groove cross-section lower frame member 19 in the upper floor wall panel 18 placed on the floor sub-lining material 17, the floor sub-lining material 17, the upper frame reinforcing member 15, and the web 35 of the upper frame member 13 in the lower floor wall panel 12, as shown FIG. 4(*a*), FIG. 4(*b*) (and FIG. 3(*a*), FIG. 3(*b*)), are provided with the elongated through holes 20 long in the member longitudinal direction superposed at the center in the member width direction. Further, the front ends of the upper and lower flanges 21 at the end joist or side joist 16 are provided with V-shaped or other notched parts 22 such as shown in FIG. 5(*a*) to prevent interference with the shaft body of the metal connection member body 4. Alternatively, when the widths of the upper and lower flanges 21 of the end joist or side joist 16 are wide, as shown in FIG. 5(*b*), holes are formed in the middle parts of the upper and lower flanges 21 in the width direction, for example, elongated holes 22 long in the member longitudinal direction are provided.

As one embodiment of the case of arranging the joint fitting 1 between members bridging the upper floor or lower floor, the lower joint part 3 in the joint fitting 1 between members is inserted from the upper floor side through the elongated through holes 20 of the members (19, 17, 15, 13) with the width direction of the joint part 3 oriented in the same direction as the long side directions of the elongated through holes 20 so as to arrange the lower joint part 3 at the lower floor side.

Further, as shown in FIG. 4(*b*) by the two-dot chain line, the middle part of the joint fitting 1 between members is positioned at the members (19, 17, 15, 13) and rotated 90° so as to horizontally turn in that state, then the flat part 2 of the upper floor joint part 3 is moved horizontally and brought into contact with the web 23 in the upper floor vertical frame members 11 so that the middle part of the joint fitting 1 between members is positioned at the notched parts 22 of the upper and lower flanges 21 of the end joist or side joist 16 and is fastened to the web of the upper floor vertical frame member 11 in the horizontal orientation by drill screws or bolts or other fasteners 24.

Further, the joint part 3 arranged at the lower floor side is brought into contact with the web 23 of the vertical frame member 11 comprised of the vertical frame stud in the lower floor wall panel 12 and fastened there by fastening devices comprised of drill screws 24 or bolts or other fasteners.

As another embodiment of the case of arranging the joint fitting 1 between members bridging the upper floor and lower floor, the upper joint part 3 (or lower joint part 3) in the joint fitting 1 between members is inserted from the lower floor side through the elongated through holes 20 of the members (13, 15, 17, 19) so as to arrange the upper joint part 3 at the upper floor side.

Next, the joint fitting 1 is horizontally rotated 90° and moved horizontally to the vertical frame member 11, the middle part of the joint fitting 1 is positioned at the notched parts 22 of the upper and lower flanges 21 at the end joist or side joist 16, then the joint part 3 is brought into contact with the web 23 in the lower floor vertical frame member 11 and fastened by joint devices comprised of horizontally oriented drill screws 24 or bolts or other fasteners.

Further, the joint part 3 arranged at the upper floor side is fastened to the web 23 of the vertical frame member 11 comprised of the vertical frame stud in the upper floor wall panel 12 by fastening devices comprised of drill screws 24 or bolts or other fasteners.

As explained above, in the upper floor wall panel 18 and lower floor wall panel 12 connected by the joint fitting 1 between members, when an upward tensile force acts on the upper floor wall panel 18 at the time of an earthquake, wind load, etc., it is transmitted from the web 23 of the vertical frame member 11 of the upper floor wall panel 18 through the plurality of drill screws 24 or other fasteners, upper floor joint part 3, metal connection member body 4, lower floor joint part 3, the plurality of drill screws 24 or other fasteners, and the web 23 of the lower floor wall panel 12 to the lower floor wall panel 12, so it is possible to prevent the floor sub-lining material 17 and end joist or side joist 16 from being compressed.

Further, when a downward compressive force acts on the upper floor wall panel 18 at the time of an earthquake, wind load, etc., it is transmitted from the web 23 of the vertical frame member 11 of the upper floor wall panel 18 through the plurality of drill screws 24 or other fasteners, upper floor joint part 3, metal connection member body 4, lower floor joint part 3, the plurality of drill screws 24 or other fasteners, and the web 23 of the lower floor wall panel 12 to the lower floor wall panel 12, so the floor joint 17 and end joist or side joist 16 are not compressed.

Further, when an upward force acts on the lower floor wall panel 12 at the time of an earthquake, wind load, etc., it is transmitted from the web 23 of the vertical frame member 11 of the lower floor wall panel 12 through the plurality of drill screws 24 or other fasteners, lower floor joint part 3, metal connection member body 4, upper floor joint part 3, the plurality of drill screws 24 or other fasteners, and the web 23 of the upper floor wall panel 12 to the upper floor wall panel 18, so the floor joint 17 and end joist or side joist 16 are not compressed.

Further, when a downward force acts on the lower floor wall panel 12 at the time of an earthquake, wind load, etc., it is transmitted from the web 23 of the vertical frame member 11 of the lower floor wall panel 12 through the plurality of drill screws 24 or other fasteners, lower floor joint part 3, metal connection member body 4, upper floor joint part 3, plurality of drill screws 24 or other fasteners, and web 23 of the upper floor wall panel 12 to the upper floor wall panel 18, so the floor joint 17 and end joist or side joist 16 are not compressed.

Second Embodiment

Figure 8:
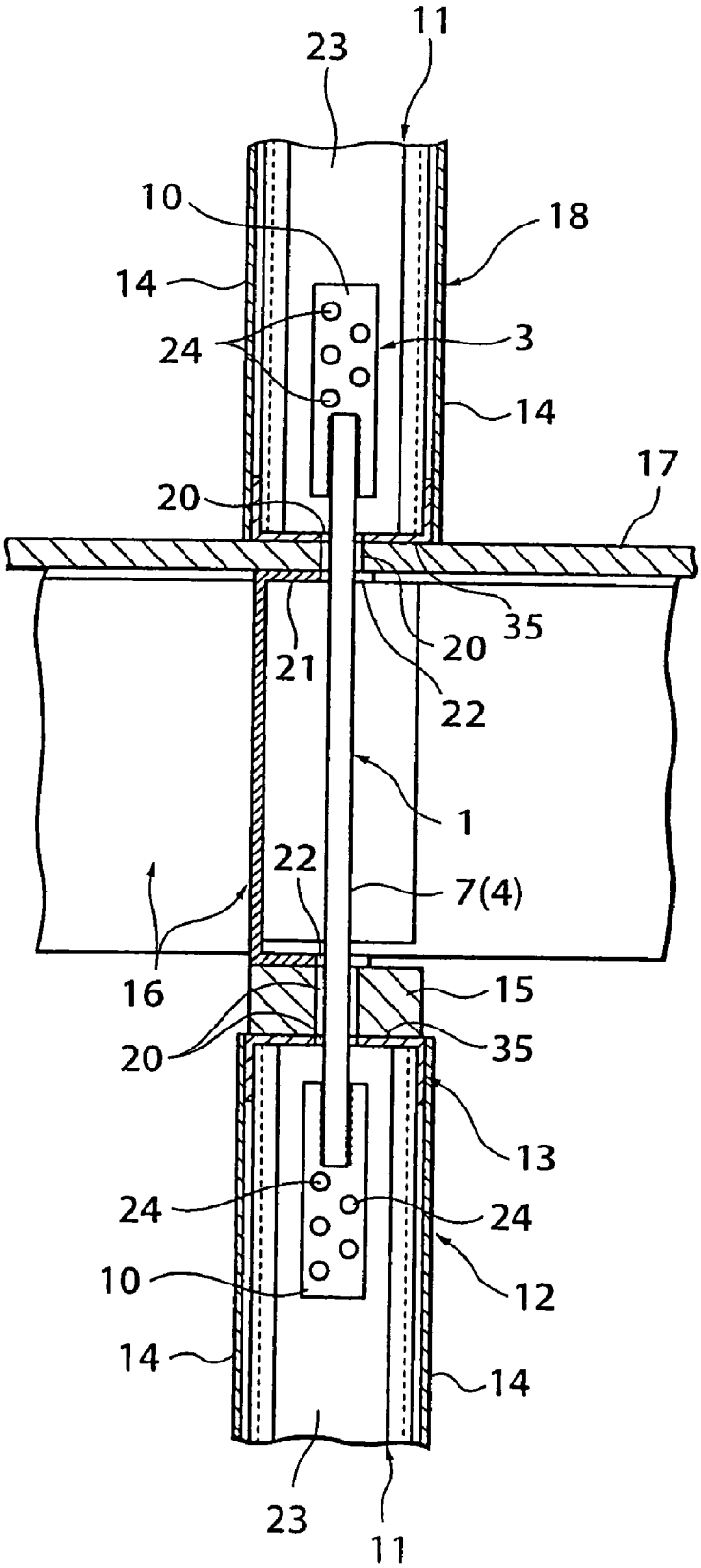
FIG. 8 is a vertical front view of the state of using a joint fitting between members of a second embodiment of the present invention to join vertical frame members of upper and lower floors.
Figure 9A:
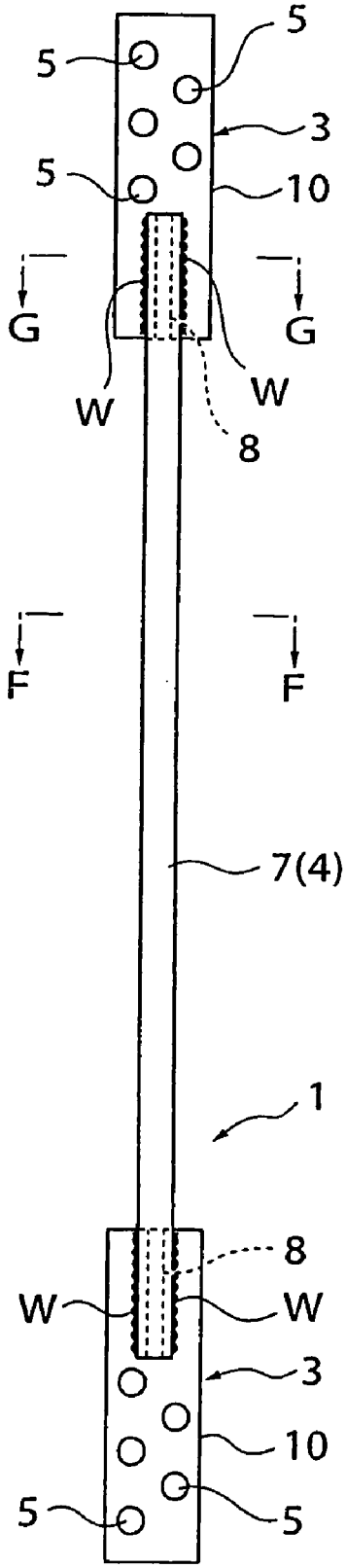
FIG. 9(*a*) is a front view of a joint fitting between members used in FIG. 8.
Figure 9B:
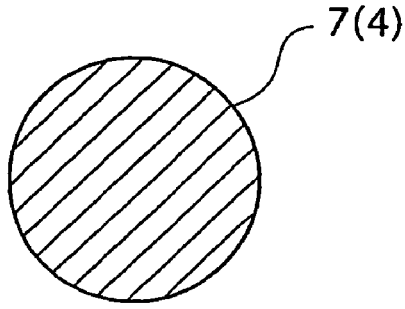
Figure 9C:
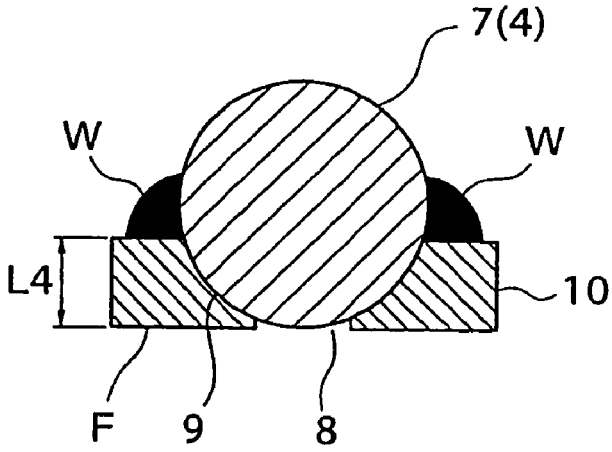

FIG. 8 and FIG. 9(*a*), FIG. 9(*b*), FIG. 9(*c*) show the joint fitting 1 between members of a second embodiment of the present invention and a joint structure of upper and lower floor vertical frame members using the same. The parts differing from the above embodiment is mainly the configuration of the joint fitting 1 between members, so these different parts will mainly be explained.

In this embodiment, the joint fitting 1 between members is comprised of a metal connection member body 4 made of a steel bar 7 and flat joint parts 3 at the two ends of the steel bar 7 obtained by welding W notched grooved joint plates 10 comprised of rectangular steel sheets having starting holes 5 at one end and having notched grooves 8 at the middle in the width direction at the other end, more specifically notched grooved joint plates 10 opened toward the ends at one end are used, a plurality of starting holes 5 for drill screws are provided at the other ends of the notched grooved joint plates 10, the ends of the steel bar 7 are fit into the notched grooves 8 so as to be supported there, and the steel bar 7 is fastened to the joint plates 10 by continuous welding along the longitudinal direction of the steel bar to form a joint fitting 1 for upper and lower floor external frame members. This joint fitting 1 for upper and lower floor external frame members is used to join the webs 23 of the upper and lower floor vertical frame members 11, but other structures and installation methods are similar to this embodiment.

If using such a joint fitting 1 for upper and lower floor external frame members, it is possible to obtain a joint fitting 1 for upper and lower floor external frame members with a high bending rigidity and buckling strength. Further, it is possible to separately fabricate the steel bar 7 and joint plates 10 and thus easily fabricate a joint fitting 1 using high precision parts. Further, it is possible to minimize the offset attachment of the steel bar 7 in the thickness direction due to the thicknesses of the joint plates 10, reduce the offset distance L4 (see FIG. 9c) between the joint surfaces F of the joint plates 10 and the center axis of the steel bar 7, and reduce the bending moment acting between the vertical frame members 11 and the joint fitting 1 for upper and lower floor external frame members. Further, since the fitting 1 becomes one with small horizontal dimensions at the ends of the joint fitting 1, it is possible to reduce the elongated dimensions of the elongated through holes 20 provided at the upper and lower floor members (19, 17, 15, 13).

Third Embodiment

Figure 10:
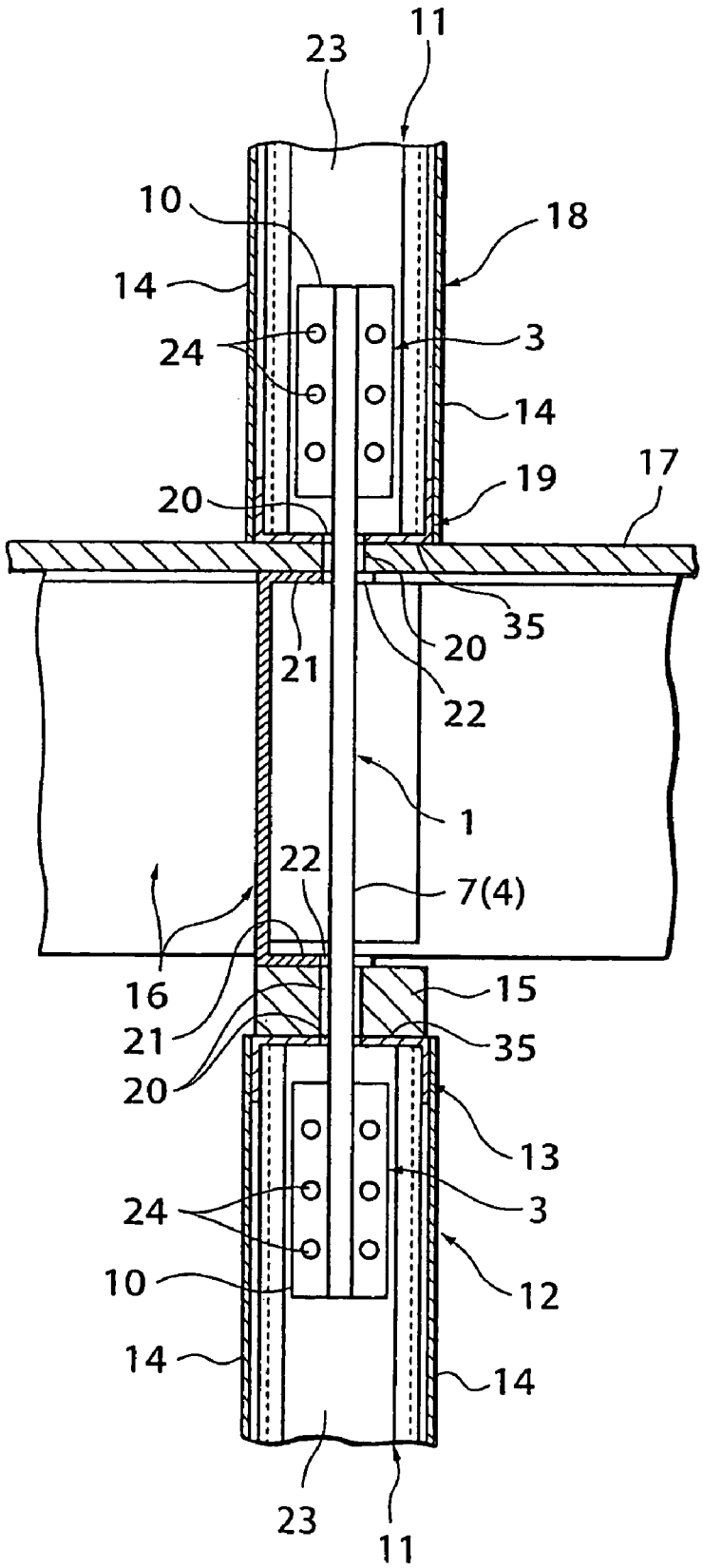
FIG. 10 is a vertical front view of the state of using a joint fitting between members of a third embodiment of the present invention to join vertical frame members of upper and lower floors.
Figure 11A:
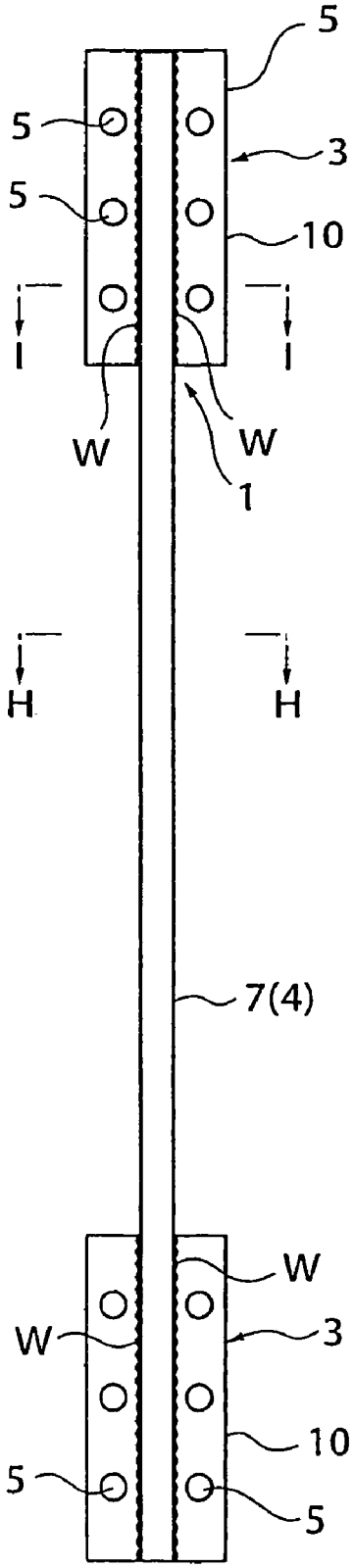
FIG. 11(*a*) is a front view of a joint fitting between members used in FIG. 10.
Figure 11B:
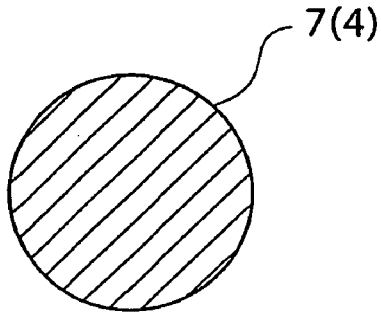
Figure 11C:
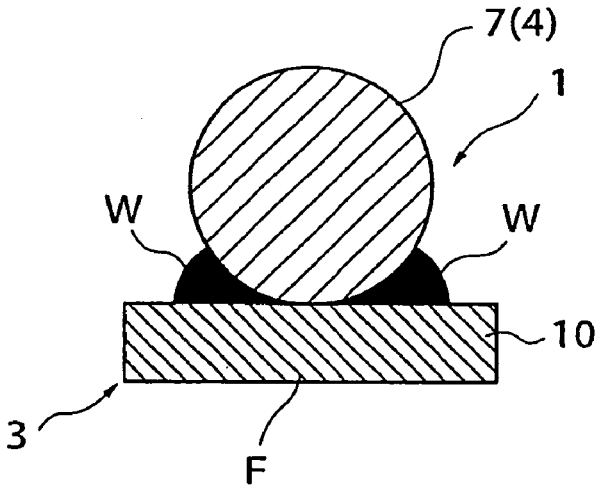
Figure 12A:
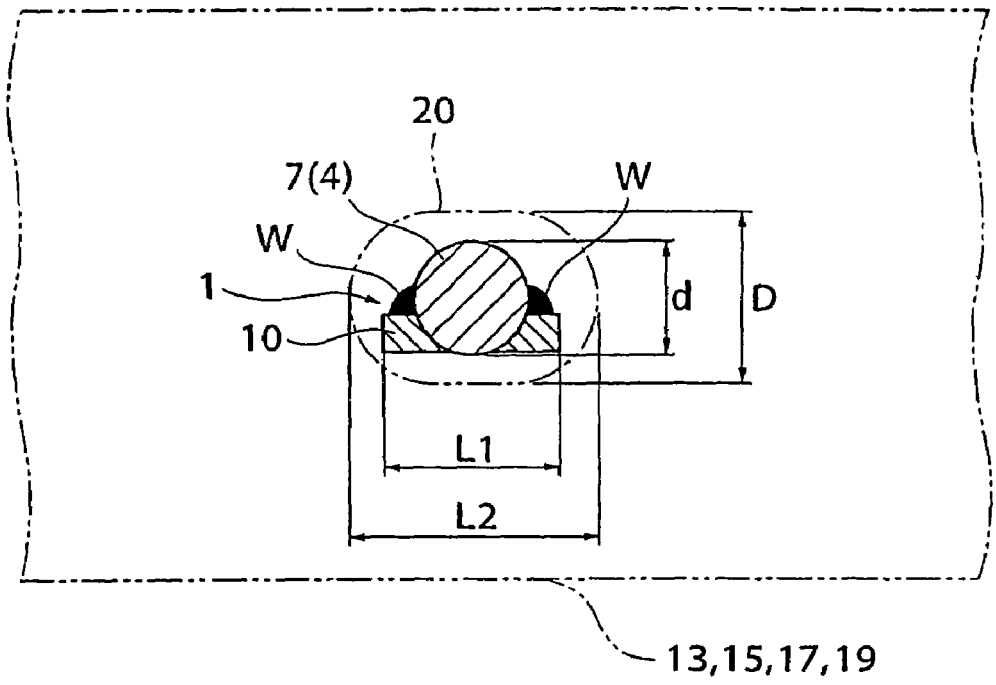
FIG. 12(*a*) is a partial horizontal sectional plan view showing the relationship between the joint fitting between members and through hole used in the second and third embodiments.
Figure 12B:
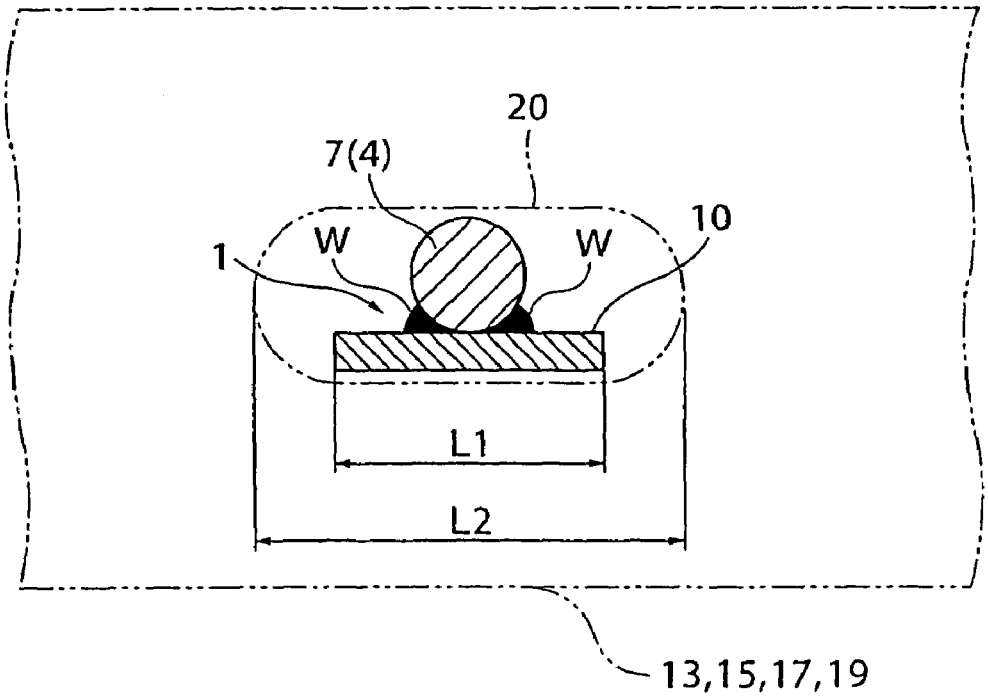

FIG. 10 and FIG. 11(*a*), FIG. 11(*b*), FIG. 11(*c*) show a joint fitting 1 between members of a third embodiment of the present invention and a joint structure of upper and lower floor vertical frame members using the same.

The point of difference from the above embodiments is that the steel sheet joint plates 10 are not provided with notched parts. The surfaces of the joint plates 10 have the two ends of the steel bar 7 fastened to them by welding W. Starting holes 5 are provided at the two sides of this weld zone W. In this embodiment, since the joint plates do not have to be given notched grooves etc., it is possible to inexpensively fabricate a joint fitting 1 between members with a large rigidity of the joint plates 10.

Using such joint plates 10 is effective when it is possible to make the long side dimensions of the elongated through holes 20 provided at the upper floor and lower floor members (19, 17, 15, 13) relatively long. The rest of the configuration is similar to that of the above embodiments, so similar parts are assigned the same reference numerals and explanations thereof are omitted.

Fourth Embodiment

Figure 13:
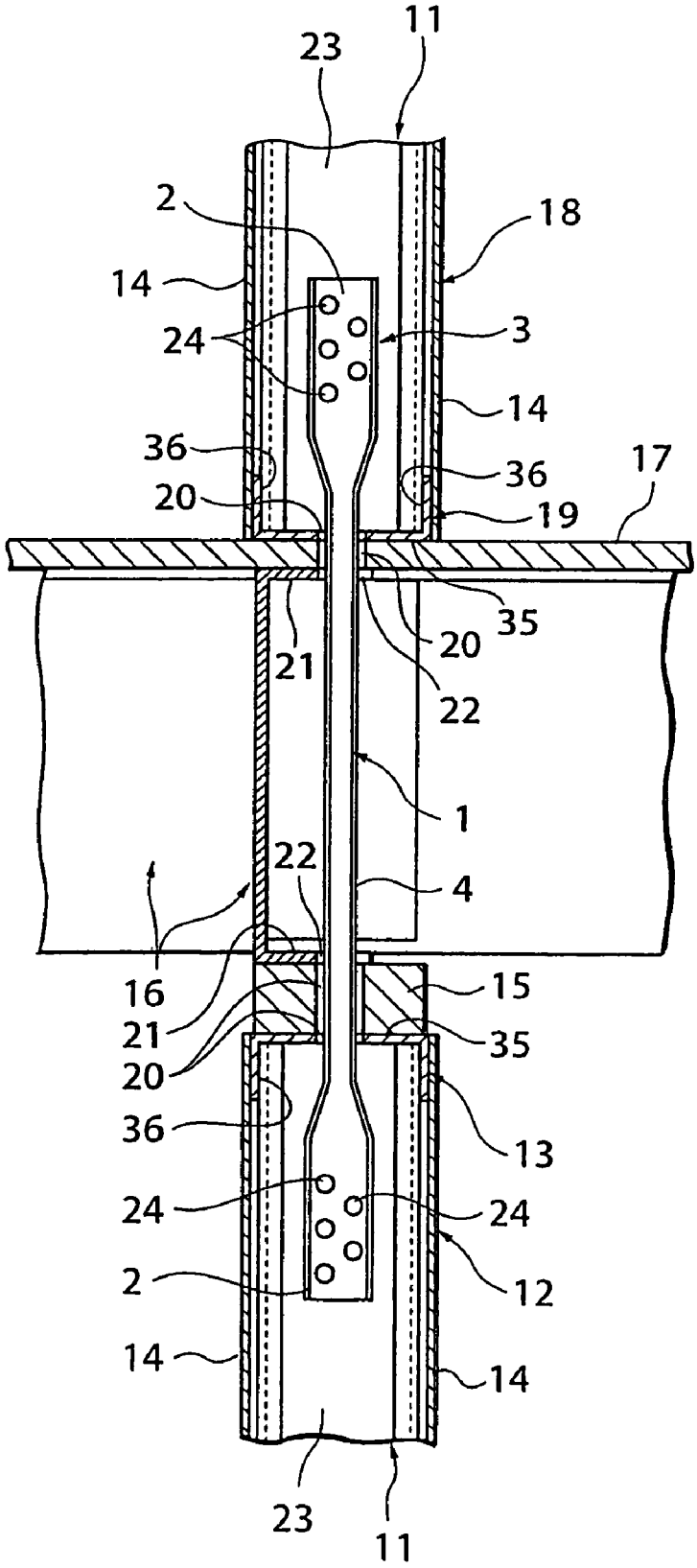
FIG. 13 is a vertical front view of the state of using a joint fitting between members of a fourth embodiment of the present invention to join vertical frame members of upper and lower floors.
Figure 14A:
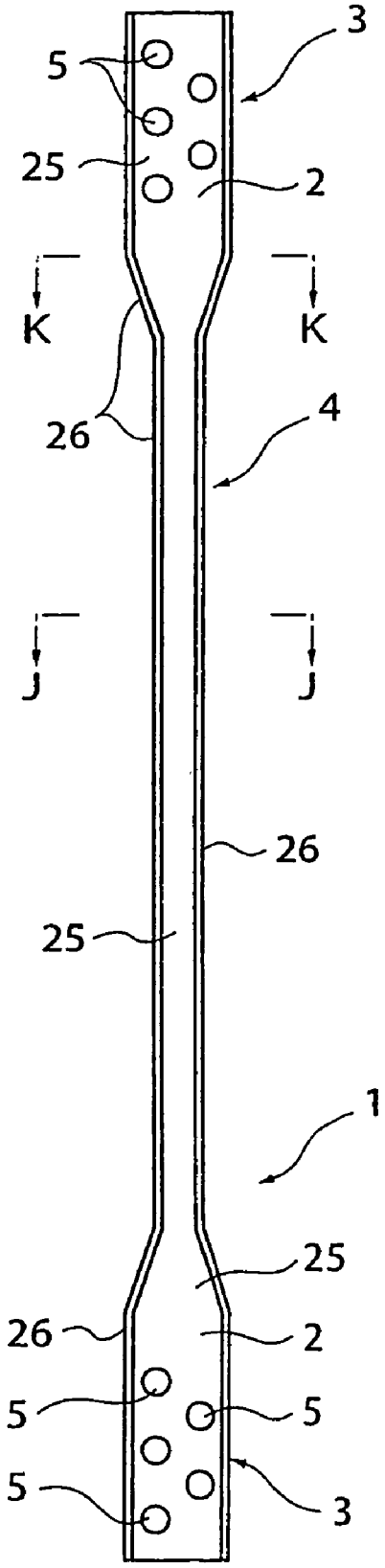
FIG. 14(*a*) is a front view of a joint fitting between members used in FIG. 13.
Figure 14B:
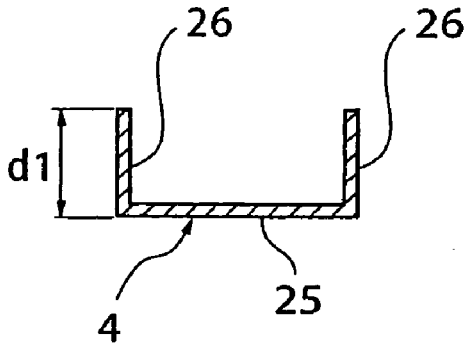
Figure 14C:
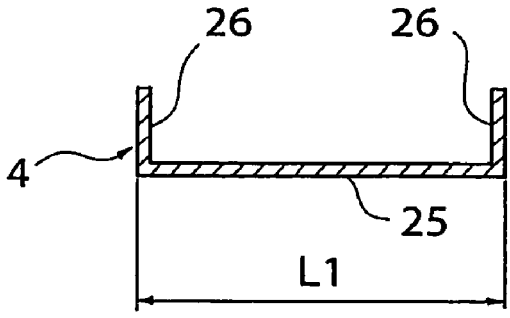
Figure 15A:
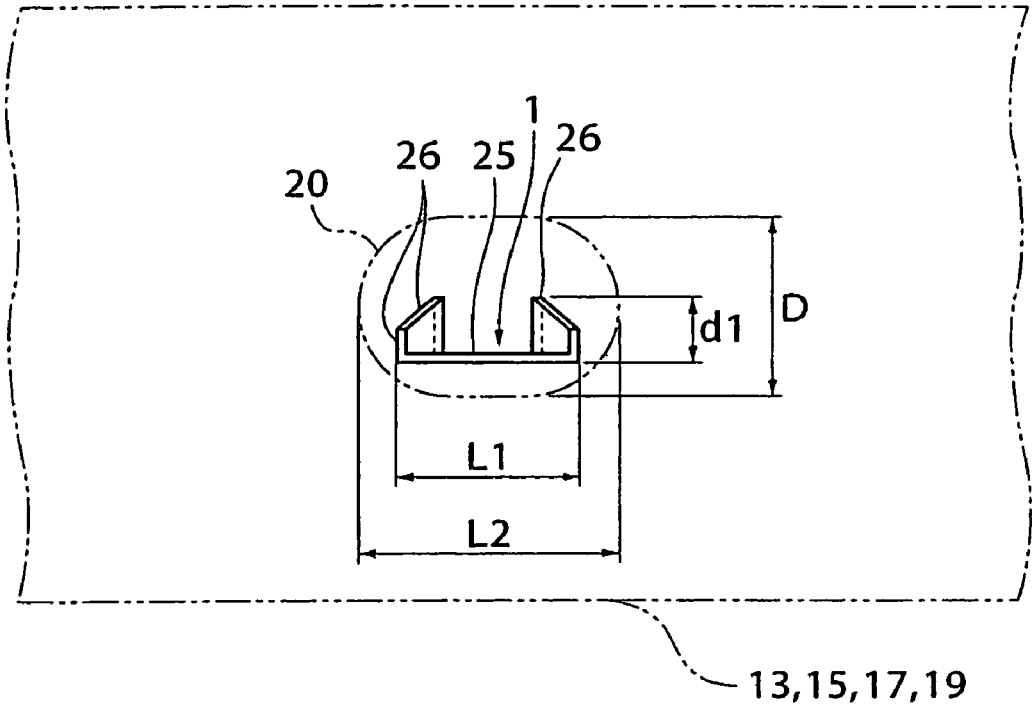
FIG. 15(*a*) is a partial horizontal sectional plan view showing the relationship between the joint fitting between members and through hole used in the fourth embodiment.
Figure 15B:
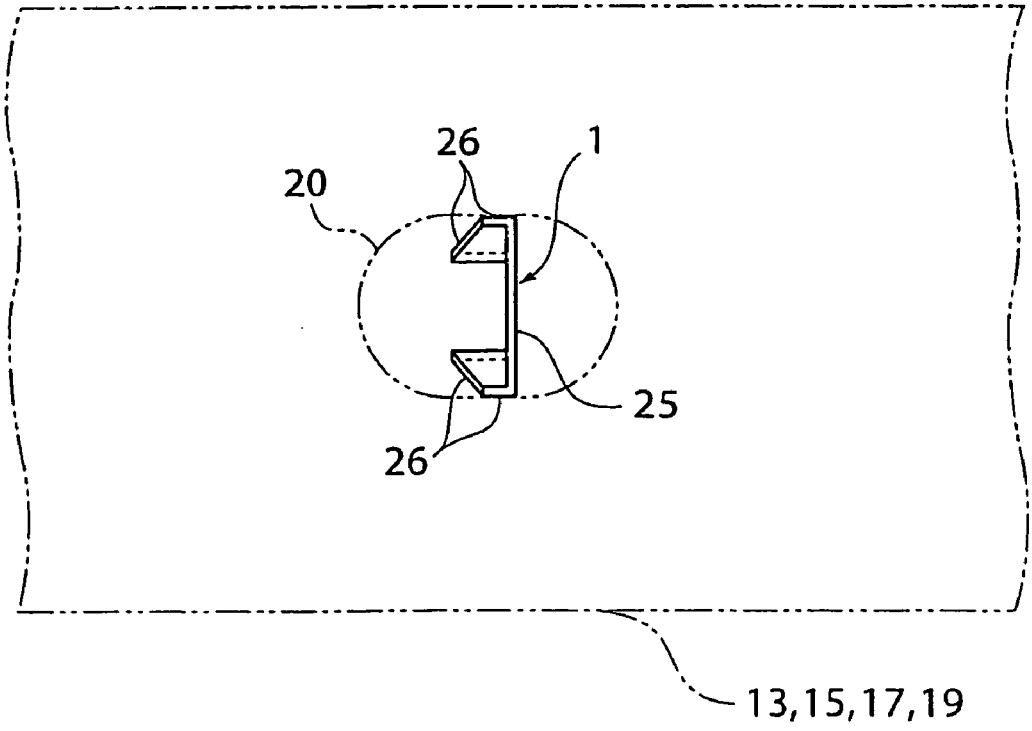

FIG. 13 to FIG. 15(*a*), FIG. 15(*b*) show a joint fitting 1 between members and a joint structure of upper and lower floor vertical frame members using the same of a fourth embodiment of the present invention.

The joint fitting 1 between members of this embodiment is made of steel sheet bent to form a web 25 at the two sides of which flanges 26 are provided to form a groove cross-section steel material comprising a metal connection member body 4.

The parts of the web 25 at the two ends of the metal connection member body 4 are broadened. The flat parts formed by the web 25 there are formed with pluralities of starting holes 5 and made joint parts 3. The width dimension L1 of the web 25 at the parts of the joint parts 3 is made broader than the width dimension of the web 25 at the middle of the metal connection member body 4 in the vertical direction, the width dimension d1 of the flanges 26 of the middle part of the metal connection member body 4 in the vertical direction is enlarged, and the width is narrowed so that the bending rigidity of the middle part becomes larger.

When working the present invention, as the metal connection member body 4 and joint plate 10, a steel or aluminum alloy or other large strength and rigidity metal material is preferably used. In particular, if steel pipe or steel sheet or other commercially available steel material, an inexpensive joint fitting 1 between members can be provided.

When working the present invention, the elongated through hole 20 may be shaped as a rectangle or other suitable shape in addition to an oval shape. Further, the notched parts 22 may be suitable shapes in addition to V-shapes.

The invention claimed is:

1. A joint fitting between members with ends to be connected to separate members so as to transmit compressive force and tensile force, said joint fitting between members characterized in that said joint fitting between members is provided with a metal connection member body having a length enabling arrangement bridging one member and another member to be joined and joint parts directly joining with these members at its two ends, and an external dimension in the width direction at an intermediate part of the joint fitting between members is made smaller than the external dimension in the width direction at the two ends, the external dimensions in the width direction at the two ends are made smaller than the dimension in the long side direction of the through holes provided in one member and another member inserted through and larger than the dimensions in the short side direction of the through holes, and the external dimension in the width direction at the intermediate part is made smaller than the dimensions in the short side direction of the through holes.

2. A joint fitting between members connecting an upper floor vertical frame member and a lower floor vertical frame member to transmit compressive force and tensile force, said joint fitting between members characterized in that said joint fitting between members is provided with a metal connection member body having a length enabling it to be arranged bridging the upper floor vertical frame member and lower floor vertical frame member in a vertical orientation and joint parts directly joining with these vertical frame members at its two ends, and an external dimension in the width direction at an intermediate part of the joint fitting between members is made smaller than the external dimension in the width direction at the two ends, the external dimensions in the width direction at the two ends are made smaller than the dimension in the long side direction of the through holes provided in upper floor members and lower floor and other members inserted through and larger than the dimensions in the short side direction of the through holes, and the external dimension in the width direction at the intermediate part is made smaller than the dimensions in the short side direction of the through holes.

3. A joint fitting between members as set forth in claim 1 or 2, characterized in that said metal connection member body is comprised of a single steel pipe which is deformed by crushing at its two ends to form flat parts and the flat parts are formed with joint parts.

4. A joint fitting between members as set forth in claim 3, characterized in that the two ends of said steel pipe are shaped with recessed cross-sections provided with projections at the two sides of the flat parts in the width direction and those parts are made the joint parts.

5. A joint fitting between members as set forth in claim 3, characterized in that said flat parts are provided with starting holes for joining use.

6. A joint fitting between members as set forth in claim 1 or 2, characterized in that said metal connection member body is comprised of a steel bar which has joint plates having joint parts fastened to it at its two ends in the longitudinal direction and in that said joint plates are arranged co-planar.

7. A joint fitting between members as set forth in claim 6, characterized in that said joint plates are formed with notched parts and in that parts of the ends of the steel bar in the radial direction are arranged accommodated in the grooves formed by the notched parts so as not to stick out and are fastened to the joint plates by welding.

8. A joint fitting between members as set forth in claim 1 or 2, characterized in that the joint hardware is made a metal connection member body comprised of steel sheet bent to form a steel material with a groove shaped cross-section and in that the two ends of the metal connection member body are formed with joint parts having flat parts.

9. A joint fitting between members as set forth in claim 1 or 2, characterized in that said joint parts are made joint parts able to be joined by drill screws or bolts or other fasteners.

10. A joint structure between adjoining members in a building characterized in that a joint fitting between members of claim 1 is used and in that adjoining horizontal frame members or floor joists or roof truss chord members or other adjoining members in a building are joined.

11. A method of joining members characterized by forming a joint structure of claim 10 during which bringing one joint part of the joint parts of the two ends at the joint fitting between members of claim 1 into contact with the member to be joined to and fastening it by providing drill screws or bolts or other fasteners bridging the joint part and the member to be joined to, then bringing the other joint part into contact with the other member to be joined to and fastening it by providing drill screws or bolts or other fasteners.

12. A joint structure of upper and lower floor vertical frame members characterized in that upper and lower joint parts in a joint fitting between members of claim 2 are brought into contact with vertical side surfaces of the vertical frame members of the floors and are fastened by drill screws or bolts or other fasteners provided bridging the joint parts and vertical frame members in a horizontal orientation.

13. A method of joining upper and lower floor vertical frame members characterized by forming a joint structure of claim 12 during which bringing one joint part of the upper and lower joint parts in a joint fitting between members of claim 2 into contact with a vertical side surface of the frame member of either of the upper and lower floors and fastening it by providing drill screws or bolts or other fasteners bridging the joint part and vertical frame member in a horizontal orientation, then bringing the other joint part into contact with the vertical side surface of the vertical frame member of the other floor and fastening it by providing drill screws or bolts or other fasteners in a horizontal orientation.

* * * * *

UNITED STATES PATENT AND TRADEMARK OFFICE

CERTIFICATE OF CORRECTION

PATENT NO. : 7,665,271 B2
APPLICATION NO. : 10/559246
DATED : February 23, 2010
INVENTOR(S) : Kawai et al.

It is certified that error appears in the above-identified patent and that said Letters Patent is hereby corrected as shown below:

On the Title Page:

The first or sole Notice should read --

Subject to any disclaimer, the term of this patent is extended or adjusted under 35 U.S.C. 154(b) by 1084 days.

Signed and Sealed this

Seventh Day of December, 2010

David J. Kappos

David J. Kappos
*Director of the United States Patent and Trademark Office*